US007773049B2

(12) United States Patent
Ueno et al.

(10) Patent No.: US 7,773,049 B2
(45) Date of Patent: Aug. 10, 2010

(54) CROSSTALK ELIMINATION CIRCUIT, LIQUID CRYSTAL DISPLAY APPARATUS, AND DISPLAY CONTROL METHOD

(75) Inventors: Masafumi Ueno, Urayasu (JP); Naoko Kondo, Tenri (JP); Hiroyuki Furukawa, Sakura (JP); Yasuhiro Yoshida, Chiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 860 days.

(21) Appl. No.: 10/594,023

(22) PCT Filed: May 9, 2005

(86) PCT No.: PCT/JP2005/008432

§ 371 (c)(1),
(2), (4) Date: Sep. 22, 2006

(87) PCT Pub. No.: WO2005/111979

PCT Pub. Date: Nov. 24, 2005

(65) Prior Publication Data

US 2007/0222724 A1 Sep. 27, 2007

(30) Foreign Application Priority Data

May 13, 2004 (JP) ..... 2004-143006
Jun. 10, 2004 (JP) ..... 2004-172049
Apr. 28, 2005 (JP) ..... 2005-132118

(51) Int. Cl.
*G09G 3/20* (2006.01)

(52) U.S. Cl. ..... 345/58; 345/87; 345/204

(58) Field of Classification Search ..... 345/58, 345/87, 90, 204
See application file for complete search history.

(56) References Cited

U.S. PATENT DOCUMENTS 5,128,785 A 7/1992 Yoshimoto et al.
5,726,910 A 3/1998 Toma et al.
5,798,740 A 8/1998 Bitzakidis et al.
5,841,411 A 11/1998 Francis et al.

(Continued)

FOREIGN PATENT DOCUMENTS

EP 0 412 497 A2 2/1991

(Continued)

*Primary Examiner*—Amare Mengistu
*Assistant Examiner*—Gene W Lee
(74) *Attorney, Agent, or Firm*—Birch, Stewart, Kolasch & Birch, LLP

(57) ABSTRACT

The crosstalk of a display apparatus can be efficiently eliminated to realize a precise, high-quality display. A liquid crystal display apparatus includes, as a crosstalk elimination circuit, an adjacent picture element acquisition circuit (1) that acquires display signals of picture elements adjacent to a self picture element, and two-dimensional LUTs (2) that use the display signals of the adjacent picture elements, acquired by the adjacent picture element acquisition circuit (1), to correct display signals of the self picture element so as to correct RGB display signals. The picture element display signals as corrected by the correction values output from the LUTs (2) are output to a source driver (4) via a timing controlling unit (TC) (3). In the crosstalk elimination circuit, the display signals of a picture element to be corrected and those of picture elements adjacent to the picture element that influence the picture element are used to acquire a correction value, thereby correcting the display signals of the correction target picture element.

8 Claims, 11 Drawing Sheets

U.S. PATENT DOCUMENTS

| | | | | |
|---|---|---|---|---|
| 6,320,562 | B1 * | 11/2001 | Ueno et al. | 345/87 |
| 6,489,938 | B1 | 12/2002 | Ito et al. | |
| 6,573,928 | B1 * | 6/2003 | Jones et al. | 348/51 |
| 6,774,875 | B2 | 8/2004 | Tong et al. | |
| 6,900,796 | B2 * | 5/2005 | Yasunishi et al. | 345/204 |
| 7,236,181 | B2 * | 6/2007 | Ho et al. | 345/601 |
| 2001/0043180 | A1 | 11/2001 | Mori et al. | |
| 2001/0048407 | A1 * | 12/2001 | Yasunishi et al. | 345/60 |
| 2002/0067324 | A1 | 6/2002 | Aoki | |
| 2003/0011585 | A1 | 1/2003 | Aoki | |
| 2005/0168424 | A1 * | 8/2005 | Nakamoto et al. | 345/89 |
| 2005/0275668 | A1 * | 12/2005 | Feng | 345/694 |
| 2006/0044830 | A1 | 3/2006 | Inoue et al. | |

FOREIGN PATENT DOCUMENTS

| | | | | |
|---|---|---|---|---|
| JP | 2-187788 | A | | 7/1990 |
| JP | 4-68391 | A | | 3/1992 |
| JP | 8-321964 | A | | 12/1996 |
| JP | 9-508222 | A | | 8/1997 |
| JP | 11-202298 | A | | 7/1999 |
| JP | 11-509652 | A | | 8/1999 |
| JP | 2000-206560 | A | | 7/2000 |
| JP | 2000-321559 | A | | 11/2000 |
| JP | 2002-321559 | A | | 11/2000 |
| JP | 2001-13482 | A | | 1/2001 |
| JP | 2002-41000 | A | | 2/2002 |
| JP | 2002-229530 | A | | 8/2002 |
| JP | 2005201980 | A | * | 7/2005 |
| JP | 2005-352437 | A | | 12/2005 |
| TW | 490701 | B | | 6/2002 |
| TW | 231393 | B | | 4/2005 |
| WO | WO-96/16393 | A1 | | 5/1996 |
| WO | WO-97/44774 | A2 | | 11/1997 |
| WO | WO-2005/109393 | A1 | | 11/2005 |

* cited by examiner

FIG. 3

| SELF PICTURE ELEMENT LEVEL | ADJACENT PICTURE ELEMENT LEVEL | | | | | | | |
|---|---|---|---|---|---|---|---|---|
| | 0 | 1 | 2 | 3 | 4 | ... | 254 | 255 |
| 0 | 0 | 0 | 0 | 0 | 0 | | 0 | 0 |
| 1 | 0 | 0 | 0 | 0 | −1 | | −2 | −2 |
| 2 | 0 | 0 | 0 | −1 | −1 | | −2 | −2 |
| 3 | 0 | 0 | −1 | −1 | −1 | | −3 | −3 |
| 4 | 0 | −1 | −1 | −2 | −2 | | −4 | −4 |
| ⋮ | | | | | | ... | | |
| 254 | 0 | −1 | −1 | −2 | −3 | | −8 | −9 |
| 255 | 0 | 0 | −1 | −1 | −2 | | −7 | −8 |

FIG. 4

B

| SELF PICTURE ELEMENT LEVEL | ADJACENT PICTURE ELEMENT LEVEL | | | | | | |
|---|---|---|---|---|---|---|---|
| | 0 | 8 | 16 | 24 | | 248 | 256 |
| 0 | 0 | 0 | 0 | 0 | | 0 | 0 |
| 4 | 0 | 4 | 6 | 8 | | 18 | 20 |
| 8 | 0 | 5 | 7 | 9 | | 20 | 22 |
| 12 | 0 | 6 | 8 | 10 | A | 22 | 24 |
| 16 | 0 | 7 | 9 | 11 | | 24 | 26 |
| ⋮ | | | | | ... | | |
| 248 | | | | | | | |
| 252 | 0 | 0 | 1 | 1 | | 4 | 4 |
| 256 | 0 | 0 | 0 | 0 | | 1 | 1 |

$B_2$ $B_1$

FIG. 7

| SELF PICTURE ELEMENT LEVEL | ADJACENT PICTURE ELEMENT LEVEL | | | | | | | | | | | | |
|---|---|---|---|---|---|---|---|---|---|---|---|---|---|
| | 0 | ··· | 40 | 48 | 56 | 64 | 72 | 80 | 88 | ··· | 240 | 248 | 256 |
| 0 | 0 | ··· | 0 | 0 | 0 | 0 | 0 | 0 | 0 | ··· | 0 | 0 | 0 |
| ⋮ | | ··· | | | | | | | | ··· | | | |
| 48 | 0 | | −6 | −6 | −6 | −7 | −7 | −7 | −7 | | −15 | −16 | −16 |
| 52 | 0 | | −6 | −6 | −7 | −7 | −7 | −7 | −8 | | −16 | −17 | −18 |
| 56 | 0 | | −7 | −7 | −7 | −7 | −7 | −8 | −8 | | −16 | −18 | −19 |
| 60 | 0 | | −7 | −7 | −7 | −7 | −8 | −8 | −8 | | −17 | −18 | −20 |
| 64 | 0 | | −7 | −7 | −8 | −8 | −8 | −8 | −9 | | −17 | −19 | −21 |
| 68 | 0 | | −7 | −7 | −7 | −8 | −8 | −8 | −9 | | −17 | −19 | −21 |
| 72 | 0 | | −6 | −7 | −7 | −7 | −7 | −8 | −8 | | −17 | −19 | −21 |
| 76 | 0 | | −6 | −6 | −6 | −6 | −6 | −7 | −7 | | −17 | −19 | −20 |
| ⋮ | | ··· | | | | | | | | ··· | | | |

FIG. 11

LEVELS OF COLOR DIFFERENCE (ΔE)

| COLOR DIFFERENCE (ΔE) | DEGREE OF COLOR DIFFERENCE |
|---|---|
| ~0.8 | LIMIT OF SETTING STRICT COLOR DIFFERENCE STANDARD FROM VIEW POINT OF REPRODUCIBILITY OF VISUAL DETERMINATION |
| 0.8~1.6 | LEVEL AT WHICH ADJACENT COMPARISON COLOR DIFFERENCE CAN BE RECOGNIZED |
| 1.6~3.2 | SUBSTANTIALLY UNNOTICEABLE IN SPACED COMPARISON |
| 3.2~6.5 | RANGE THAT CAN BE HANDLED AS SAME COLOR AT IMPRESSION LEVEL |
| 6.5~13 | COLOR DIFFERENCE CORRESPONDING TO THAT OF MUNSELL COLOR CHART |
| 13~ | COLOR DIFFERENCE TO THE EXTENT THAT CAN BE RECOGNIZED BETWEEN COLOR GROUPS |

FIG. 12
(A)
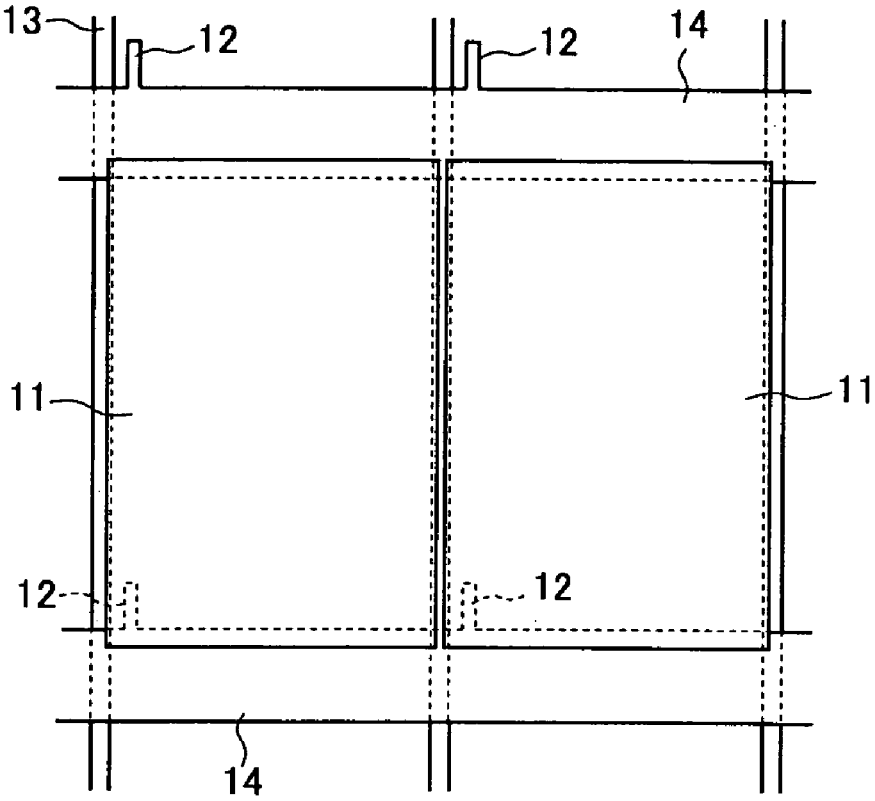
(B)
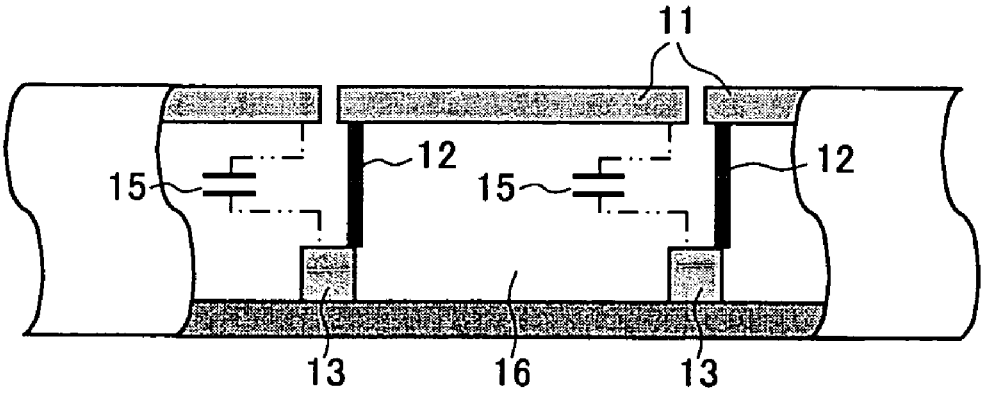

CROSSTALK ELIMINATION CIRCUIT, LIQUID CRYSTAL DISPLAY APPARATUS, AND DISPLAY CONTROL METHOD

TECHNICAL FIELD

The present invention relates generally to a crosstalk elimination circuit, a liquid crystal display apparatus, and a display control method, and, more particularly, to a crosstalk elimination circuit for eliminating crosstalk of a liquid crystal display apparatus to display high-quality images, a liquid crystal display apparatus equipped with the crosstalk elimination circuit, and a display control method of eliminating crosstalk to display high-quality images.

BACKGROUND OF THE INVENTION

Liquid crystal displays are widely used for displays of computers and television receivers. Active matrix type liquid crystal panels including thin film transistors (TFT) are frequently used for address elements in liquid crystal displays.

In such an active matrix type liquid crystal panel using TFT, recently, a panel has been realized with the use of an SHA (Super High Aperture Ratio) technology, which is a super high aperture ratio technology that achieves higher luminance, higher contrast, and lower electric power consumption.

FIG. 12 is a diagram for describing a configuration example of a picture element electrode in a TFT liquid crystal panel using the SHA technology; FIG. 12(A) is a plane schematic view of a picture element electrode unit; and FIG. 12(B) is a schematic configuration diagram of a sectional side view of the picture element electrode unit. In FIG. 12: 11 is a picture element electrode; 12 is TFT; 13 is a source line; 14 is a gate line; 15 is a parasitic capacitance; and 16 is a special resin.

A plurality of the picture element electrodes 11 is formed in a matrix shape on an active matrix substrate. The TFT 12 is a switching element disposed for each picture element electrode 11 and is connected to each picture element electrode 11. The gate electrode of the TFT 12 is connected to the gate line 14 for supplying a scan signal and the TFT is driven and controlled by a gate signal input to the gate electrode. Each picture element corresponding to each picture element electrode 11 is referred to as a sub-pixel and is used normally for displaying one color of RGB. A group of three picture elements of RGB is referred to as a pixel.

The source electrode of the TFT 12 is connected to the source line 13 for supplying a display signal (data signal) and when the TFT 12 is driven, the display signal is input to the picture element electrode 11 through the TFT 12. The gate line 14 and the source line 13 are disposed orthogonal to each other around the picture element electrode 11 disposed in a matrix shape.

In the liquid crystal panel with the SHA configuration, the special resin 16 is used for an interlayer dielectric film to acquire a super high aperture ratio. As shown in FIG. 12(B), the picture element electrode 11 is disposed above the source line 13 via the special resin 16 to have a three-dimensional structure. This inevitably generates the parasitic capacitance 15 between the picture element electrode 11 and the source line 13.

Since the parasitic capacitance 15 is created between the source line 13 supplying the display signal to one picture element electrode and the source line 13 supplying the display signal to another picture element electrode adjacent to the picture element electrode, two capacity couplings are formed for one picture element electrode.

If the aforementioned active matrix type display apparatus has, for example, a plane structure (Non-SHA) without the three-dimensional structure described above and does not have the parasitic capacitance 15, the voltage of the source line 13 is applied to the picture element electrode 11 only when the gate line 14 is turned on and this electric charge is retained for one frame period when the gate line 14 is turned off. However, if the capacity coupling is generated due to the parasitic capacitance 15, the electric charge retained by the picture element electrode 11 becomes unsteady due to leakage or application through the parasitic capacitance 15. This factor causes crosstalk and a problem of image quality deterioration.

FIG. 13 illustrates spectral characteristics of a typical color filter and, as shown in FIG. 13, transmissivity of primary colors of the color filter overlap each other and have an effect on color purity of display color. Such an effect on display color is induced by optical factors such as leakage light from a polarization plate as well as wavelength dependency of the light transmissivity and is a kind of optical crosstalk.

With regard to such a problem, for example, patent document 1 discloses an active matrix type liquid crystal display apparatus that achieves a balance of capacities between one picture element electrode and signal lines on both sides to prevent a display defect such as crosstalk by extending a shield electrode along a signal line from an auxiliary capacity line intersecting with the signal line, by superimposing one edge side of the shield electrode on the picture element electrode, by superimposing the other edge side on adjacent picture element electrode, and by differentiating the superimposing lengths L1, L2.

Patent document 2 discloses a crosstalk correcting apparatus of a plasma address type display apparatus compensating diffusion in an insulating layer of a drive voltage (a voltage applied to liquid crystal), which generates and outputs an output signal DG[n]=input signal SG[n]+correction signal H((SG[n]−SR[n])+(SG[n]−SB[n])) for a picture element G[n].

Patent Document 1: Japanese Laid-Open Patent Publication No. 2000-206560

Patent Document 2: Japanese Laid-Open Patent Publication No. 2000-321559

DISCLOSURE OF THE INVENTION

Problems To Be Solved By The Invention

As described above, each picture element electrode 11 of an active matrix type liquid crystal panel has capacity coupling due to a parasitic capacitance 15 between a source line 13 of the self picture element and the source line 13 of the adjacent picture element. The crosstalk is generated because an effective voltage retained by the picture element electrode 11 is changed due to the existence of the capacity coupling when TFT 12 is turned off.

In the invention of patent document 1, for the purpose of eliminating display defects due to light leakage, a superimposing width of the light shield and the pixel electrode is increased only for a region where orientation defects of the liquid crystal occur so as not to generate crosstalk, and the effect of the crosstalk is not corrected which is caused by the certain adjacent picture element as described above.

Since the configuration of the liquid crystal panel is complicated in the invention of patent document 1, a manufacturing process becomes cumbersome and the increase in costs is expected. It will be also problematic that the transmissivity of the liquid crystal panel is reduced by increasing the superimposing width of the light shield and the pixel electrode.

Although an output signal DG[n] of a target pixel G[n] is obtained by using input signals SR[n], SB [n] to pixels R[n], B[n] located on both adjacent sides of the target pixel G[n] and a crosstalk correction coefficient H is used in the invention of patent document 2, no grounds for the crosstalk correction coefficient H (and crosstalk coefficient K) are described in patent document 2.

Although the invention of patent document 2 prevents electric crosstalk due to display signals input to two adjacent electrodes adjacent to the target picture element electrode in the direction perpendicular to the source line, it is problematic that crosstalk cannot be eliminated when the crosstalk is generated in the directions other than the direction perpendicular to the source line.

For example, in the case of the invention of patent document 2, it is problematic that the effect of the crosstalk cannot be corrected on a time axis generated by the display signals input to other picture element electrodes during one future frame period after the display signal is input to the target picture element electrode until the next time the display signal is input again.

In the case of the invention of patent document 2, it is problematic that the effect of the electric crosstalk cannot be corrected which is generated by the display signals input to other picture element electrodes arranged in the direction horizontal to the source line relative to the target picture element electrode.

The invention of patent document 2 also has a problem that an effect of optical crosstalk cannot be corrected.

In the invention of patent document 2, the crosstalk can be corrected only when a relationship between the crosstalk correction coefficient H and the crosstalk coefficient K satisfies $H=K/(1-3K)$ and the picture element signal level of the same color is identical in the adjacent pixel ($SR[n]=SR[n+1]$, $SB[n]=SB[n-1]$), and it is problematic that when a considerable difference exists between a pixel to which the target picture element belongs and the adjacent pixel thereof, i.e., when a considerable signal difference exists between the target picture element and the picture element of the same color in the adjacent pixel, an error is generated in the correction (in accordance with magnitude of the difference).

The present invention was conceived in consideration of the current conditions described above and it is therefore the object of the present invention to provide a crosstalk elimination circuit, a liquid crystal display apparatus, and a display control method that can effectively remove the crosstalk generated between the picture element electrodes arranged not only in the direction perpendicular to the source line of the display apparatus but also in the horizontal and oblique directions and the crosstalk generated during one future frame period after the display signal in input to the picture element to enable accurate and higher-quality image display.

Although the display apparatus has also optical crosstalk that is induced by the wavelength dependency of the light transmissivity of the color filter, the leakage light from the polarization plate, etc., the present invention is intended to provide a crosstalk elimination circuit, a liquid crystal display apparatus, and a display control method that generate an LUT correction value of the crosstalk elimination circuit based on optical measurement result in consideration of the optical crosstalk to eliminate the electric and optical crosstalk in all the directions at the same time and to enable accurate and higher-quality image display.

MEANS FOR SOLVING THE PROBLEMS

A first technical means is a crosstalk elimination circuit that corrects a display signal input to each of a plurality of picture element electrodes provided in a liquid crystal panel to eliminate crosstalk of a liquid crystal display apparatus using the liquid crystal panel, the circuit comprising an LUT that inputs a display signal of a correction target picture element and a display signal of an adjacent picture element adjacent to a source line of the correction target picture element in a certain vertical direction, the LUT outputting a correction signal for correcting the display signal of the correction target picture element, and an adjacent picture element correction LUT for correcting the display signal of the adjacent picture element adjacent to the correction target picture element, wherein the adjacent picture element correction LUT uses a display signal of a next adjacent picture element adjacent to a source line of the adjacent picture element in a certain vertical direction and the display signal of the adjacent picture element to extract correction value data of the adjacent picture element, which are output as an adjacent picture element correction signal, and wherein the LUT for correcting the correction target picture element inputs the display signal of the adjacent picture element corrected with the use of the signal output from the adjacent picture element correction LUT and the display signal of the correction target picture element to extract the correction data of the correction target picture element.

By correcting the display signal input to the target picture element electrode with the correction value extracted with the use of the LUT, the effect of the crosstalk generated between the picture element electrodes of the liquid crystal panel can be removed to display higher-quality images. Since the crosstalk correction value is extracted with the use of the LUT, the crosstalk can be corrected accurately under any conditions, unlike the disclosure of above patent document 2, for example, which only can correct crosstalk accurately under the certain condition that the picture element signal level of the same color is identical in the adjacent pixel.

Although a crosstalk amount generally varies in accordance with the magnitude relationship between the display signal level of the correction target picture element and the display signal level of the adjacent picture element affecting the correction target picture element to generate the crosstalk, since this variation is nonlinear, a process efficiency is improved by using the LUT and costs can be reduced accordingly.

In crosstalk correction, if the crosstalk flows from right to left in the horizontal direction of the screen, the crosstalk must be corrected sequentially from the rightmost picture element on the screen in a relay mode. However, since a real time process is difficult and is not practical in this method, the crosstalk can be corrected with the same accuracy as the relay mode by correcting the adjacent picture element from the next adjacent picture element and correcting the correction target picture element from the corrected adjacent picture element.

Although a crosstalk amount generally varies in accordance with the magnitude relationship between the display signal level of the correction target picture element and the display signal level of the adjacent picture element affecting the correction target picture element to generate the crosstalk, since this variation is nonlinear, a process efficiency is improved by using the LUT and costs can be reduced accordingly.

A second technical means is the crosstalk elimination circuit of the first technical means wherein signal level intervals for setting the correction value data in the adjacent picture element correction LUT are established more roughly than the signal level intervals for setting the correction value data in the LUT for correcting the correction target picture element.

Although a doubled LUT is needed and the circuit scale is increased if the LUT has a two-stage configuration as described in the first technical means, since the correction value may not be very strict when the adjacent picture element is corrected, a first stage LUT for correcting the adjacent picture element can be set more roughly than a second stage LUT for correcting the target picture element. This can constrain the negative effect increasing the circuit scale.

A third technical means is the crosstalk elimination circuit of the first technical means wherein signal level intervals for setting the correction value data in the LUT are established roughly by a predetermined level width relative to a level width that may be achieved by the signal level of the display signal input to each picture element electrode.

The LUT with a reduced circuit scale can be constructed by establishing the signal level intervals for setting the correction value data in the LUT roughly by the predetermined level width relative to the level width that may be achieved by the level of the display signal for each picture element.

A fourth technical means is the crosstalk elimination circuit of the third technical means wherein when extracting from the LUT the correction value data corresponding to the signal level between the signal levels with the correction value data set, the target correction value data are extracted by performing linear interpolation between the signal levels.

When using the LUT as in the third technical means, it is expected that the correction accuracy is reduced as compared to the level width that may be achieved by the level of the display signal for each picture element, and the crosstalk can be corrected more accurately by linearly interpolating the correction value between the roughly set levels to prevent the reduction in the correction accuracy.

A fifth technical means is the crosstalk elimination circuit of the fourth technical means wherein when the LUT is created by omitting regions where the correction value data are zero which are extracted with the use of the signal level of the correction target picture element and the signal level of the adjacent picture element and when the linear interpolation is performed between a signal level having the correction value data of zero and a signal level set adjacently to the signal level, intended correction value data are extracted by performing the linear interpolation between the correction value data of the adjacently set signal level and fixed correction value data 0 defined in advance.

In the case of extracting the intended correction value data by linearly interpolating the correction value between levels set in the LUT as described in the fourth technical means, if the LUT is constituted with, for example, a level width of eight levels, which is set as the level width that may be achieved by the level of the display signal for each picture element, the LUT can store only 32 levels of the correction values and the interpolation cannot be performed with the endmost level. By setting the fixed value for the endmost data as described above, interpolation can be performed with the fixed value and it is not needed to construct a plurality of tables for the interpolation.

A sixth technical means is the crosstalk elimination circuit of the third technical means wherein the signal level intervals for setting the correction value data in the LUT are established with finer intervals of the signal levels of the correction target picture element as compared to the signal levels of the adjacent picture element.

By establishing the signal level intervals for setting the correction value data in the LUT with finer intervals of the signal levels of the correction target picture element as compared to the signal levels of the adjacent picture element, the capacity scale of the LUT is reduced and the crosstalk can be corrected more flexibly and accurately.

A seventh technical means is the crosstalk elimination circuit of the first technical means wherein the LUT is disposed for each primary color of RGB to enable individual setup of the correction value of the LUT for each color.

That is, since the crosstalk amount is different for the picture element electrode of each primary color, the crosstalk can be corrected more faithfully by setting the correction data independently for each primary color. Since the optical crosstalk is also different for each primary color, the crosstalk can be corrected more faithfully by setting the correction data independently for each primary color.

An eighth technical means is a liquid crystal display apparatus provided with the crosstalk elimination circuit of any one of the first to seventh technical means.

Since the aforementioned crosstalk elimination circuit is disposed, the liquid crystal display apparatus can be realized which can correct the crosstalk accurately.

A ninth technical means is a liquid crystal display apparatus that uses an active matrix type liquid crystal panel with a plurality of picture element electrodes formed in a matrix shape to display color images by applying voltages to the picture element electrodes and by retaining this electric charge for one frame period, the apparatus comprising a correcting portion that corrects a display signal input to each picture element electrode, the correcting portion correcting the display signal to be input to the picture element electrode such that the display luminance of the picture element has a color difference $\Delta E=6.5$ or less relative to the display luminance that should actually be displayed, regardless of display signals input to picture element electrodes of the entire screen.

Since the crosstalk is generated because the quantity of the electric charge applied to the picture element electrode is changed by the changes in the electric potentials of the source line of the picture element electrode and the source line of the adjacent picture element electrode adjacent to the source line of the picture element electrode in the vertical direction, the crosstalk can be eliminated more accurately and higher-quality images can be displayed by monitoring the display signals input to the picture element electrodes arranged along each source line of the entire screen to correct the display signal to be input to the picture element electrode.

A tenth technical means is the liquid crystal display apparatus of the ninth technical means wherein the correcting portion generates a correction signal for the display signal to be input to the picture element electrode with the use of the display signals to be input to the picture element electrodes arranged along each source line and the display signal to be input to the picture element electrode.

The crosstalk can be corrected more accurately by configuring a computing equation or LUT for obtaining a crosstalk correction amount in consideration of a degree of change in the display luminance of the picture element electrode due to the display signals to be input to picture element electrodes arranged along each source line of the entire screen and the display signal to be input to the picture element electrode and in consideration of a relationship among the level of the display signal to be input to the picture element electrode, the levels of the display signals to be input to the picture element electrodes arranged along each source line on this occasion and by obtaining the correction signal for the picture element electrode from the display signal to be input to the picture element electrode and the display signals to be input to picture element electrodes arranged along each source line.

An eleventh technical means is the liquid crystal display apparatus of the ninth technical means wherein the correcting portion corrects the display signal to be input to the picture element electrode during a period after the display signal is input to the picture element electrode such that the display luminance of the picture element has a color difference $\Delta E=6.5$ or less relative to the display luminance that should actually be displayed, regardless of a display signal input to a picture element electrode other than the picture element electrode.

Since the crosstalk is generated because the quantity of the electric charge formed by applying a voltage to the picture element electrode is changed by the change in the electric potential of the source line for the supply to other picture element electrodes during a period after the voltage is applied to the picture element electrode, the crosstalk can be eliminated more accurately and higher-quality images can be displayed by monitoring the display signals input to other picture element electrodes during a period after the display signal is input to the picture element electrode to correct the display signal to be input to the picture element electrode.

A twelfth technical means is the liquid crystal display apparatus of the tenth technical means wherein the correcting portion generates the correction signal for the display signal to be input to the picture element electrode during a period after the timing when the display signal should be input to the picture element electrode with the use of a display signal to be input to a picture element electrode other than the picture element electrode and the display signal to be input to the picture element electrode.

The crosstalk can be corrected more accurately by configuring a computing equation or LUT for obtaining a crosstalk correction amount in consideration of a degree of change in the display luminance of the picture element electrode due to the display signals to be input to other picture element electrodes during a period after the timing when the display signal should be input to the picture element electrode and in consideration of a relationship between the level of the display signal to be input to the picture element electrode and the levels of the display signals to be input to other picture element electrodes on this occasion and by obtaining the correction signal for the picture element electrode from the display signal to be input to the picture element electrode and the display signals to be input to other picture element electrodes.

A thirteenth technical means is the liquid crystal display apparatus of the ninth technical means wherein the correcting portion corrects the display signal to be input to the picture element electrode during a period before the display signal is input to the picture element electrode such that the display luminance of the picture element has a color difference $\Delta E=6.5$ or less relative to the display luminance that should actually be displayed, regardless of a display signal input to a picture element electrode other than the picture element electrode.

Although the crosstalk cannot be completely corrected by this configuration as compared to the eleventh technical means, a frame memory can be reduced and a circuit scale can be reduced by performing the correction with the use of the input display signals during a period before a display signal is input to a picture element electrode.

For example, in the case of TV (television receiver), etc., high-band components of the input image are filtered in advance; no problem occurs when considering that an entire screen is substantially uniform; a difference of image signals is small between frames (inter-frame correlation is high); especially, sensitivity to color difference is low in the characteristics of the human visual sense; and, therefore, no practical problem occurs when the input signals of a period before a display signal is input to a picture element electrode are used instead of the display signals input during a period after the display signal is input to the picture element electrode in the eleventh technical means.

Therefore, while the circuit scale is reduced, a liquid crystal display apparatus can be realized which can achieve the correction effect substantially equivalent to the case that the correction is performed with the use of the display signals input to other picture element electrodes during a period after the display signal is input to the picture element electrode as described in the eleventh technical means.

A fourteenth technical means is the liquid crystal display apparatus of the tenth technical means wherein the correcting portion generates the correction signal for the display signal to be input to the picture element electrode during a period before the timing when the display signal should be input to the picture element electrode with the use of a display signal input to a picture element electrode other than the picture element electrode and the display signal to be input to the picture element electrode.

The crosstalk can be corrected more accurately by configuring a computing equation or LUT for obtaining a crosstalk correction amount in consideration of a degree of change in the display luminance of the picture element electrode due to display signals input to other picture element electrodes during a period before the timing when the display signal should be input to the picture element electrode and in consideration of a relationship between the level of the display signal to be input to the picture element electrode and the levels of display signals input to other picture element electrodes on this occasion and by obtaining the correction signal for the picture element electrode from the display signal to be input to the picture element electrode and the display signals input to other picture element electrodes.

A fifteenth technical means is a crosstalk elimination circuit of a liquid crystal display apparatus that uses an active matrix type liquid crystal panel with a plurality of picture element electrodes formed in a matrix shape to display color images by applying voltages to the picture element electrodes and by retaining this electric charge for one frame period, the apparatus comprising a correcting portion that corrects a display signal input to each picture element electrode, the correcting portion correcting the display signal to be input to the picture element electrode such that the display luminance of the picture element has a color difference $\Delta E=6.5$ or less relative to the display luminance that should actually be displayed, regardless of display signals input to picture element electrodes of the entire screen.

Since the crosstalk is generated because the quantity of the electric charge formed by applying a voltage to the picture element electrode is changed by the change in the electric potential of the source line of the picture element electrode and the source line of the adjacent picture element electrode adjacent to the source line of the picture element electrode in the vertical direction, the crosstalk can be eliminated more accurately and higher-quality images can be displayed by monitoring the display signals input to picture element electrodes arranged along each source line of the entire screen to correct the display signal to be input to the picture element electrode.

A sixteenth technical means is the crosstalk elimination circuit of the fifteenth technical means wherein the correcting portion generates a correction signal for the display signal to be input to the picture element electrode with the use of the display signals to be input to the picture element electrodes arranged along each source line and the display signal to be input to the picture element electrode.

The crosstalk can be corrected more accurately by configuring a computing equation or LUT for obtaining a crosstalk correction amount in consideration of a degree of change in the display luminance of the picture element electrode due to the display signals to be input to picture element electrodes arranged along each source line of the picture element electrode entire screen and the display signal to be input to the picture element electrode and in consideration of a relationship between the level of the display signal to be input to the picture element electrode and the levels of the display signals to be input to the picture element electrodes arranged along the source line of each picture element electrode on this occasion and by obtaining the correction signal for the picture element electrode from the display signal to be input to the picture element electrode and the display signals to be input to the picture element electrodes arranged along each source line.

A seventeenth technical means is the crosstalk elimination circuit of the fifteenth technical means wherein the correcting portion corrects the display signal to be input to the picture element electrode during a period after the display signal is input to the picture element electrode such that the display luminance of the picture element has a color difference $\Delta E=6.5$ or less relative to the display luminance that should actually be displayed, regardless of a display signal input to a picture element electrode other than the picture element electrode.

Since the crosstalk is generated because the quantity of the electric charge formed by applying a voltage to the picture element electrode is changed by the change in the electric potential of the source line for the supply to other picture element electrodes during a period after the voltage is applied to the picture element electrode, the crosstalk can be eliminated more accurately and higher-quality images can be displayed by monitoring the display signals input to other picture element electrodes during a period after a display signal is input to a picture element electrode to correct the display signal to be input to the picture element electrode.

An eighteenth technical means is the crosstalk elimination circuit of the sixteenth technical means wherein the correcting portion generates the correction signal for the display signal to be input to the picture element electrode during a period after the timing when the display signal should be input to the picture element electrode with the use of a display signal to be input to a picture element electrode other than the picture element electrode and the display signal to be input to the picture element electrode.

The crosstalk can be corrected more accurately by configuring a computing equation or LUT for obtaining a crosstalk correction amount in consideration of a degree of change in the display luminance of the picture element electrode due to the display signals to be input to other picture element electrodes during a period after the timing when the display signal should be input to the picture element electrode and in consideration of a relationship between the level of the display signal to be input to the picture element electrode and the levels of the display signals to be input to other picture element electrodes on this occasion and by obtaining the correction signal for the picture element electrode from the display signal to be input to the picture element electrode and the display signals to be input to other picture element electrodes.

A nineteenth technical means is the crosstalk elimination circuit of the fifteenth technical means wherein the correcting portion corrects the display signal to be input to the picture element electrode during a period before the display signal is input to the picture element electrode such that the display luminance of the picture element has a color difference $\Delta E=6.5$ or less relative to the display luminance that should actually be displayed, regardless of a display signal input to a picture element electrode other than the picture element electrode.

Although the crosstalk cannot be completely corrected by this configuration as compared to the seventeenth technical means, a frame memory can be reduced and a circuit scale can be reduced by performing the correction with the use of the input display signals during a period before the display signal is input to the picture element electrode.

For example, in the case of TV (television receiver), etc., high-band components of the input image are filtered in advance; no problem occurs when considering that an entire screen is substantially uniform; a difference of image signals is small between frames (inter-frame correlation is high); especially, sensitivity to color difference is low in the characteristics of the human visual sense; and, therefore, no practical problem occurs when the input signals of a period before the display signal is input to the picture element electrode are used instead of the display signals input during a period after the display signal is input to the picture element electrode in the seventeenth technical means.

Therefore, while the circuit scale is reduced, a crosstalk elimination circuit can be realized which can achieve the correction effect substantially equivalent to the case that the correction is performed with the use of the display signals input to other picture element electrodes during a period after the display signal is input to the picture element electrode as described in the seventeenth technical means.

A twentieth technical means is the crosstalk elimination circuit of the sixteenth technical means wherein the correcting portion generates the correction signal for the display signal to be input to the picture element electrode during a period before the timing when the display signal should be input to the picture element electrode with the use of a display signal input to a picture element electrode other than the picture element electrode and the display signal to be input to the picture element electrode.

The crosstalk can be corrected more accurately by configuring a computing equation or LUT for obtaining a crosstalk correction amount in consideration of a degree of change in the display luminance of the picture element electrode due to the display signals input to other picture element electrodes during a period before the timing when the display signal should be input to the picture element electrode and in consideration of a relationship between the level of the display signal to be input to the picture element electrode and the levels of the display signals input to other picture element electrodes on this occasion and by obtaining the correction signal for the picture element electrode from the display signal to be input to the picture element electrode and the display signals input to other picture element electrodes.

A twenty-first technical means is a display control method of a liquid crystal display apparatus that uses an active matrix type liquid crystal panel with a plurality of picture element electrodes formed in a matrix shape to display color images by applying voltages to the picture element electrodes and by retaining this electric charge for one frame period, the method including a correcting step of correcting a display signal input to each picture element electrode, at the correcting step, the display signal to be input to the picture element electrode being corrected such that the display luminance of the picture element has a color difference $\Delta E=6.5$ or less relative to the display luminance that should actually be displayed, regardless of display signals input to picture element electrodes of the entire screen.

Since the crosstalk is generated because the quantity of the electric charge formed by applying a voltage to the picture element electrode is changed by the change in the electric potential of the source line of the picture element electrode and the source line of an adjacent picture element electrode adjacent to the source line of the picture element electrode in the vertical direction, the crosstalk can be eliminated more accurately and higher-quality images can be displayed by monitoring the display signals input to picture element electrodes arranged along each source line of the entire screen to correct the display signal to be input to the picture element electrode.

A twenty-second technical means is the display control method of the twenty-first technical means wherein at the correcting step, a correction signal for the display signal to be input to the picture element electrode is generated with the use of the display signals to be input to the picture element electrodes arranged along each source line and the display signal to be input to the picture element electrode.

The crosstalk can be corrected more accurately by configuring a computing equation or LUT for obtaining a crosstalk correction amount in consideration of a degree of change in the display luminance of the picture element electrode due to the display signals to be input to picture element electrodes arranged along each source line of the entire screen and the display signal to be input to the picture element electrode and in consideration of a relationship between the level of the display signal to be input to the picture element electrode and the levels of the display signals to be input to the picture element electrodes arranged along each source line on this occasion and by obtaining the correction signal for the picture element electrode from the display signal to be input to the picture element electrode and the display signals to be input to the picture element electrodes arranged along the each source line.

A twenty-third technical means is the display control method of the twenty-first technical means wherein at the correcting step, the display signal to be input to the picture element electrode is corrected during a period after the display signal is input to the picture element electrode such that the display luminance of the picture element has a color difference $\Delta E=6.5$ or less relative to the display luminance that should actually be displayed, regardless of a display signal input to a picture element electrode other than the picture element electrode.

Since the crosstalk is generated because the quantity of the electric charge formed by applying a voltage to the picture element electrode is changed by the change in the electric potential of the source line for the supply to other picture element electrodes during a period after the voltage is applied to the picture element electrode, the crosstalk can be eliminated more accurately and higher-quality images can be displayed by monitoring the display signals input to other picture element electrodes during a period after the display signal is input to the picture element electrode to correct the display signal to be input to the picture element electrode.

A twenty-fourth technical means is the display control method of the twenty-second technical means wherein at the correcting step, the correction signal for the display signal to be input to the picture element electrode is generated during a period after the timing when the display signal should be input to the picture element electrode with the use of a display signal to be input to a picture element electrode other than the picture element electrode and the display signal to be input to the picture element electrode.

The crosstalk can be corrected more accurately by configuring a computing equation or LUT for obtaining a crosstalk correction amount in consideration of a degree of change in the display luminance of the picture element electrode due to the display signals to be input to other picture element electrodes during a period after the timing when the display signal should be input to the picture element electrode and in consideration of a relationship between the level of the display signal to be input to the picture element electrode and the levels of the display signals to be input to other picture element electrodes on this occasion and by obtaining the correction signal for the picture element electrode from the display signal to be input to the picture element electrode and the display signals to be input to other picture element electrodes.

A twenty-fifth technical means is the display control method of the twenty-first technical means wherein at the correcting step, the display signal to be input to the picture element electrode is corrected during a period before the display signal is input to the picture element electrode such that the display luminance of the picture element has a color difference $\Delta E=6.5$ or less relative to the display luminance that should actually be displayed, regardless of a display signal input to a picture element electrode other than the picture element electrode.

Although the crosstalk cannot be completely corrected by this configuration as compared to the twenty-third technical means, a frame memory can be reduced and a circuit scale can be reduced by performing the correction with the use of the input display signals during a period before the display signal is input to the picture element electrode.

For example, in the case of TV (television receiver), etc., high-band components of the input image are filtered in advance; no problem occurs when considering that an entire screen is substantially uniform; a difference of image signals is small between frames (inter-frame correlation is high); especially, sensitivity to color difference is low in the characteristics of the human visual sense; and, therefore, no practical problem occurs when the input signals of a period before the display signal is input to the picture element electrode are used instead of the display signals input during a period after the display signal is input to the picture element electrode in the twenty-third technical means.

Therefore, while the circuit scale is reduced, a display control method can be realized which can achieve the correction effect substantially equivalent to the case that the correction is performed with the use of the display signals input to other picture element electrodes during a period after the display signal is input to the picture element electrode as described in the twenty-third technical means.

A twenty-sixth technical means is the display control method of the twenty-second technical means wherein at the correcting step, the correction signal for the display signal to be input to the picture element electrode is generated during a period before the timing when the display signal should be input to the picture element electrode with the use of a display signal input to a picture element electrode other than the picture element electrode and the display signal to be input to the picture element electrode.

The crosstalk can be corrected more accurately by configuring a computing equation or LUT for obtaining a crosstalk correction amount in consideration of a degree of change in the display luminance of the picture element electrode due to display signals input to other picture element electrodes during a period before the timing when the display signal should be input to the picture element electrode and in consideration of a relationship between the level of the display signal input to the picture element electrode and the levels of display signals to be input to other picture element electrodes on this occasion and by obtaining the correction signal for the picture element electrode from the display signal to be input to the picture element electrode and the display signals input to other picture element electrodes.

EFFECT OF THE INVENTION

The present invention can effectively remove the crosstalk generated among the picture element electrodes arranged in horizontal, vertical, and oblique directions relative to the source line, the crosstalk due to the effect of the display signal input to other picture element electrodes during one future frame period after the display signal is input to the target picture element electrode, the optical crosstalk, etc., in the active matrix type liquid crystal display apparatus and can display accurate and higher-quality images.

Since the correction signal can be obtained which makes the display luminance of the target picture element signal substantially constant regardless of the levels of the display signals input to other picture element electrodes, the present invention can correct a mutual effect of each primary color (each picture element) in a pixel and an effect between pixels across a pixel boundary, including the crosstalk for the entire screen, in real time. Particularly, in the liquid crystal panel with the SHA configuration, higher-quality images can be provided while achieving the high quality with the super high aperture ratio.

Since the circuit capable of eliminating the crosstalk can be constructed with a simple configuration, the LSI realizing the crosstalk elimination circuit can be highly integrated and improved in processing speed, and costs can be reduced accordingly. The low consumption of the LSI driving power thus can be achieved.

BRIEF DESCRIPTION OF THE DRAWINGS

FIG. 3 is a diagram for describing one configuration example of an LUT applied to the present invention.

FIG. 4 is a diagram for describing another configuration example of the LUT applied to the present invention.

FIG. 7 shows a relevant configuration for describing a process considering a next adjacent picture element.

FIG. 11 shows levels of a color difference ΔE and general degrees of the visual sense.

FIG. 12 is a diagram for describing a configuration example of a picture element electrode in a TFT liquid crystal panel using the SHA technology.

PREFERRED EMBODIMENTS OF THE INVENTION

As described above, with regard to crosstalk, a picture element affecting a target picture element is a picture element having a source line coupled capacitively to the target picture element among picture elements adjacent to the target picture element and, therefore, a correction value is extracted by an LUT (look-up table) at least in consideration of this adjacent picture element to correct a display signal to be input to the target picture element with the correction value. Such a process can compensate the effect of the crosstalk to display higher-quality images.

Figure 1:
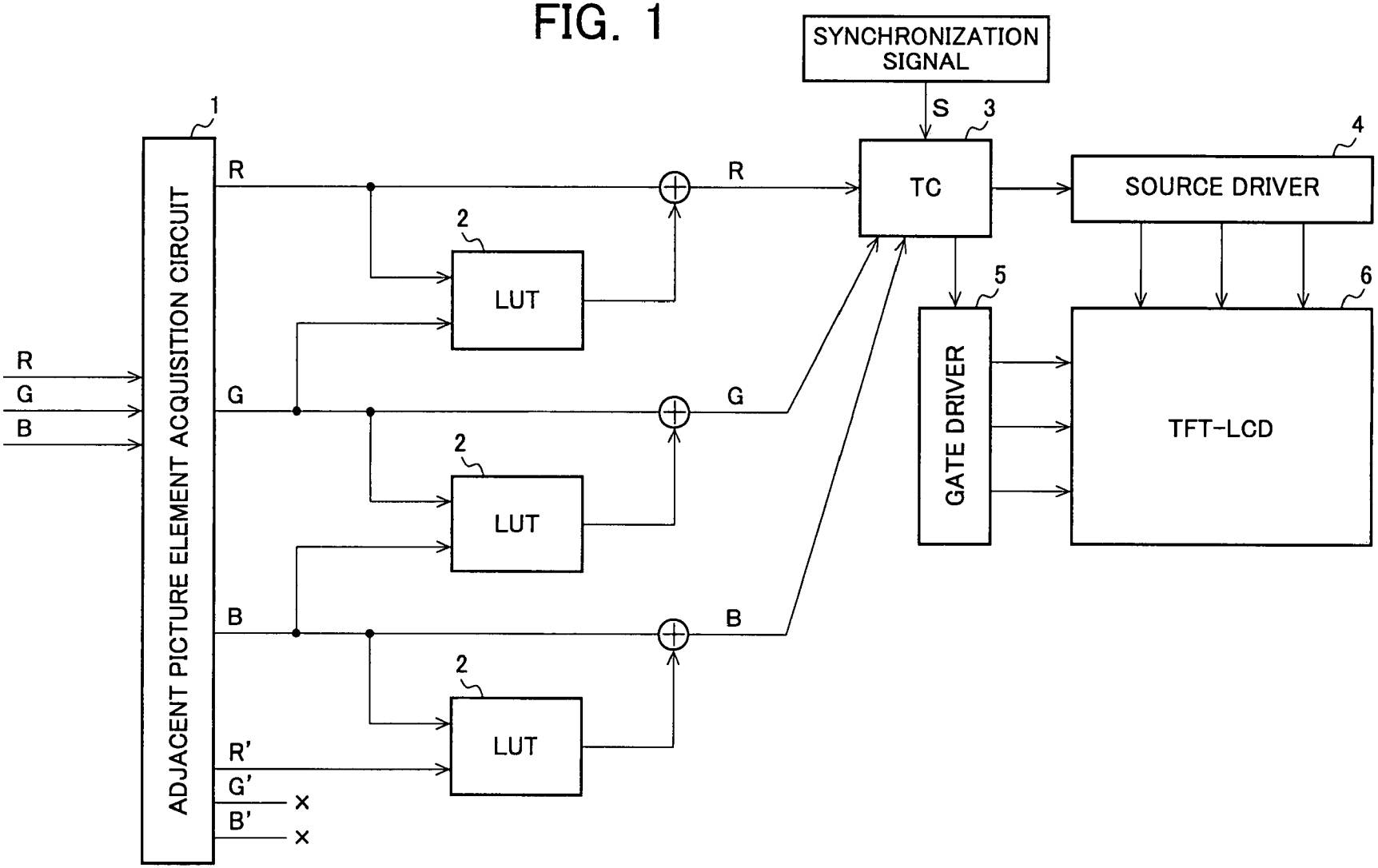
FIG. 1 is a diagram for describing one embodiment of a crosstalk elimination circuit according to the present invention.

FIG. 1 is a diagram for describing one embodiment of a crosstalk elimination circuit according to the present invention and shows a block diagram of relevant parts of a liquid crystal display apparatus.

As shown in FIG. 1, the liquid crystal display apparatus of the embodiment is provided with the crosstalk elimination circuit, which is an adjacent picture element acquisition circuit 1 that acquires a display signal of an adjacent picture element for each correction target picture element to correct RGB display signals and LUTs 2 that output a correction signal correcting the display signal of each correction target picture element with the use of the display signal of the adjacent picture element acquired by the adjacent picture element acquisition circuit 1.

The LUT 2 is formed such that a correction signal for correcting an effect of a display signal input to another adjacent picture element electrode can be output for a display signal input to one picture element electrode so as to eliminate the above-mentioned crosstalk. A specific example of the LUT 2 will be described later.

The correction signal output from the LUT2 is added to and corrects the display signal of each picture element and the corrected display signal of each picture element is input to a timing controlling unit (TC) 3. The timing controlling unit 3 outputs the display signal to a source driver 4 depending on a vertical and horizontal synchronization signal S applied externally and outputs a scan signal for scanning the TFT to a gate driver 5.

A TFT-LCD 6 has a configuration shown in FIG. 12, is disposed with a source line 13 for transmitting the display signal output from the source driver 4 and a gate line 14 for transmitting the scan signal output from the gate driver 5, and is connected to a picture element electrode 11.

Figure 2:
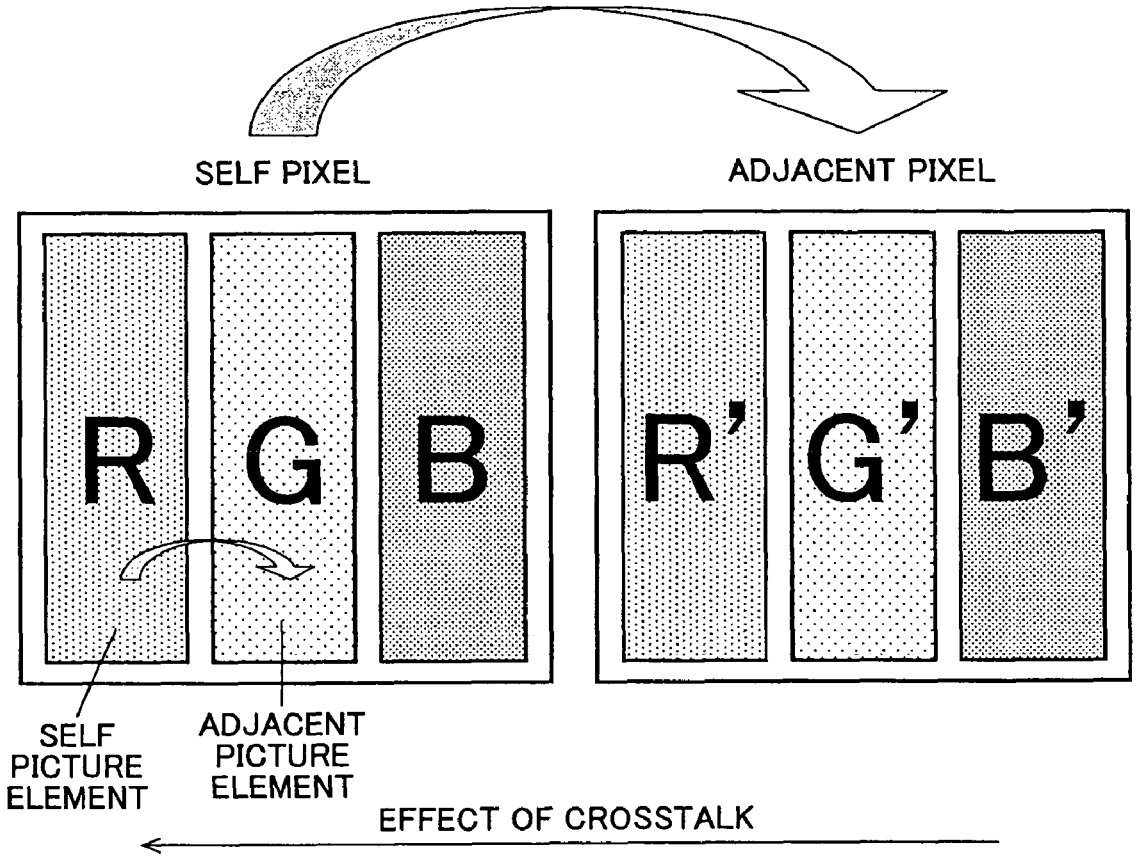
FIG. 2 is a diagram for describing a configuration example of a pixel and an effect of crosstalk in this case.

The action of the LUT according to the present embodiment will hereinafter be described specifically. FIG. 2 is a diagram for describing a configuration example of a pixel and an effect of crosstalk in this case. As described above, the crosstalk is a phenomenon that the self picture element is affected by a lighting state of the adjacent picture element on the side of capacity coupling due to a parasitic capacitance 15 and outputs a gradation different from that in the normal case. For example, in the case of a stripe-type picture element configuration shown in FIG. 2, a gradation is changed in an R picture element (R sub-pixel) of the self pixel by an effect of an adjacent G picture element. Similarly, the G picture element is affected by a B picture element and the B picture element is affected by an R' picture element of the adjacent pixel.

To correct the effects, as shown in FIG. 1, the LUT 2 corrects the level of the R output display signal from the levels of the R and G input display signals, also corrects the level of the G output display signal from the levels of the G and B input display signals, and corrects the level of the B output display signal from the levels of the B and R' input display signals.

FIG. 3 is a diagram of one configuration example of the LUT applied to the present embodiment. When the effect of the crosstalk is corrected, a correction value is fluctuated by the levels of the input display signals to the self picture element (picture element to be corrected, i.e., target picture element) and the adjacent picture element thereof. Therefore, to determine the correction value, a two-dimensional LUT is used to perform address reference using the display signal level corresponding to the self picture element and the display signal level corresponding to the adjacent picture element thereof.

For example, if the display signal for each picture element is processed by 8 bits (256 gradations), an LUT shown in FIG. 3 is created. For example, in the example shown in FIG. 3, if an input level of a display signal to a self picture element R is "4" and an input level of a display signal to an adjacent picture element G is "4", the correction value "−2" is obtained from the LUT. The obtained correction value "−2" is added to the R input level and the result is used as the output level of the R display signal. The R display signal corrected by the correction value output from the LUT is supplied to the picture element electrode of the self picture element via the timing controlling unit 3.

The LUT is disposed independently for each primary color of RGB and a different correction value can be set for each primary color of RGB. The correction value of each LUT is created in advance based on optical measurement results of the liquid crystal panel. The correction process is performed for each picture element sequentially from a picture element corresponding to the edge of the display screen and the corrected display signal is output and input to the timing controlling unit.

The LUT for each primary color may be provided in the liquid crystal display apparatus or any peripheral units and, for example, a storage means storing the LUT can be a semiconductor memory such as a ROM and a RAM.

A positional relationship of the picture element electrode and the TFT changes the orientation of the picture element arrangement affected by the crosstalk. As shown in FIG. 12, when a TFT 12 is disposed on the source line 13 to the left of the picture element electrode 11, the target picture element (self picture element) is affected by the crosstalk from the right picture element and, contrary, when the TFT 12 is disposed on the source line 13 to the right of the picture element electrode, the target picture element is affected by the crosstalk from the left picture element. For such various picture element arrangement patterns, all the patterns can be accommodated by switching the wiring of the adjacent picture element acquisition circuit 1

FIG. 4 is a diagram for describing another configuration example of the LUT applied to the present embodiment. The LUT shown in FIG. 4 can correct the display signal practically at a higher speed by reducing a circuit scale and streamlining the process.

Although the levels of the display signals to the self picture element and the adjacent picture element are set at one-level intervals to define 256 stages (=8 bits) in the example of FIG. 3, the two-dimensional LUT is formed by setting the level of the display signal to the self picture element at four-level intervals (64 stages=6 bits) and setting the level of the display signal to the adjacent picture element at eight-level intervals (32 stages=5 bits) as shown in FIG. 4, for example. By roughly establishing the signal level intervals for setting the correction value data in the LUT, the circuit scale is reduced to construct the simplified LUT.

That is, the LUT with the reduced circuit scale can be constructed by roughly establishing the signal level intervals for setting the correction value data in the LUT by a predetermined level width relative to a level width that may be achieved by the level of the display signal to each picture element (in this case, 256 stages=8 bits).

When using the LUT with the roughly set level values as described above, the correction accuracy is expected to be reduced as compared to the LUT of FIG. 3. The correction can be performed more accurately by linearly interpolating the correction value between the roughly set levels to prevent such reduction of the correction accuracy. For example, in the example of the LUT shown in FIG. 4, the display signal level of the self picture element is set to 0, 4, 8, 12 . . . 248, 252, 256 at four-level intervals and the display signal level of the adjacent picture element is set to 0, 8, 16, 24 . . . 248, 256 at eight-level intervals.

If actual input display signal levels are (self picture element, adjacent picture element)=(10, 18), since "10" is the signal level to the self picture element, "8" and "12" of the self picture element are selected as the levels for the interpolation, and since "18" is the actual signal level to the adjacent picture element, "16" and "24" of the adjacent picture element are selected as the levels for the interpolation. As a result, four numeric values "7", "8", "9", and "10" (numeric values in a shaded region A of FIG. 4) are extracted from the LUT for the linear interpolation.

First, the linear interpolation is performed in a transverse direction (horizontal direction) of the LUT. A level "7.5" is calculated by the linear interpolation from the adjacent picture element levels "7" and "9" corresponding to the self picture element level "8", and a level "8.5" is calculated by the linear interpolation from the adjacent picture element levels "8" and "10" corresponding to the self picture element level "12".

The linear interpolation is then performed in a longitudinal direction (vertical direction) of the LUT. A level "8.0" is calculated by the linear interpolation from the levels "7.5" and "8.5" obtained from the linear interpolation in the transverse direction (horizontal direction) and this value is used for the correction value.

By using at least a 10-bit signal as the internal signal of the crosstalk elimination circuit instead of the 8-bit signal as described above, a value of a fractional part of the linear interpolation is reflected and the correction can be performed more accurately.

(Interpolating Method at End of LUT)

When assuming that the LUT shown in FIG. 4 is hardware, the LUT can be realized by addresses of 6 bits for the self picture element×5 bits for the adjacent picture element. However, when the self picture element is 6-bit address, only 64 stages of the correction value can be stored in the LUT, and if the levels are established from the level "0" at four-level intervals such as (0, 4, 8 . . . 252), the interpolation cannot be performed between the endmost levels "252" and "255".

Similarly, when the adjacent picture element is 5-bit address, only 32 stages of the correction value can be stored in the LUT, and if the levels are established from the level "0" at eight-level intervals such as (0, 8, 16 . . . 248), the interpolation cannot be performed between the endmost levels "248" and "255".

Therefore, in this embodiment, if the level of the input signal of the self picture element is less than "4" or if the level of the input signal of the adjacent picture element is less than "8", the interpolation is performed with a fixed correction value "0".

This corresponds to a portion of a shaded region B of FIG. 4, and since the portion of the region B is not formed in the LUT, the LUT can be formed by establishing up to the endmost level 256 with 64 stages (=6-bit).

In the above case, since the input level "0" of the adjacent picture element is used as a reference level of the correction, the correction value is "0" when the input level of the adjacent picture element is "0". Therefore, a column $B_1$ in the region B shown in FIG. 4 may not be formed in the LUT. On the other hand, if the input level "255" of the adjacent picture element is used as a reference level of the correction, the correction values corresponding to the adjacent picture element input level of "255" become "0" on the right edge of FIG. 4, and this column is not created in the LUT.

If the input level of the self picture element is "0", the crosstalk is not generated regardless of the input level of the adjacent picture element. This is because liquid crystal molecules are completely laid down and are not affected by the operation of the adjacent picture element when the input level of the self picture element is "0" in a normally black liquid crystal panel. Therefore, if the input level of the self picture element is "0", the correction value is always "0". Therefore, a row $B_2$ in the region B shown in FIG. 4 may not be formed in the LUT.

That is, the LUT in this case is created with an omitted region where the correction value is zero which is extracted by using the level of the correction target picture element and the level of the adjacent picture element, and if the linear interpolation is performed between the level with the correction value of zero and the level established adjacently, the linear interpolation is performed between the adjacent level and the fixed correction value of zero determined in advance to extract the target correction value.

(Proportion of Self Picture Element/Adjacent Picture Element Addresses of LUT)

Figure 5:
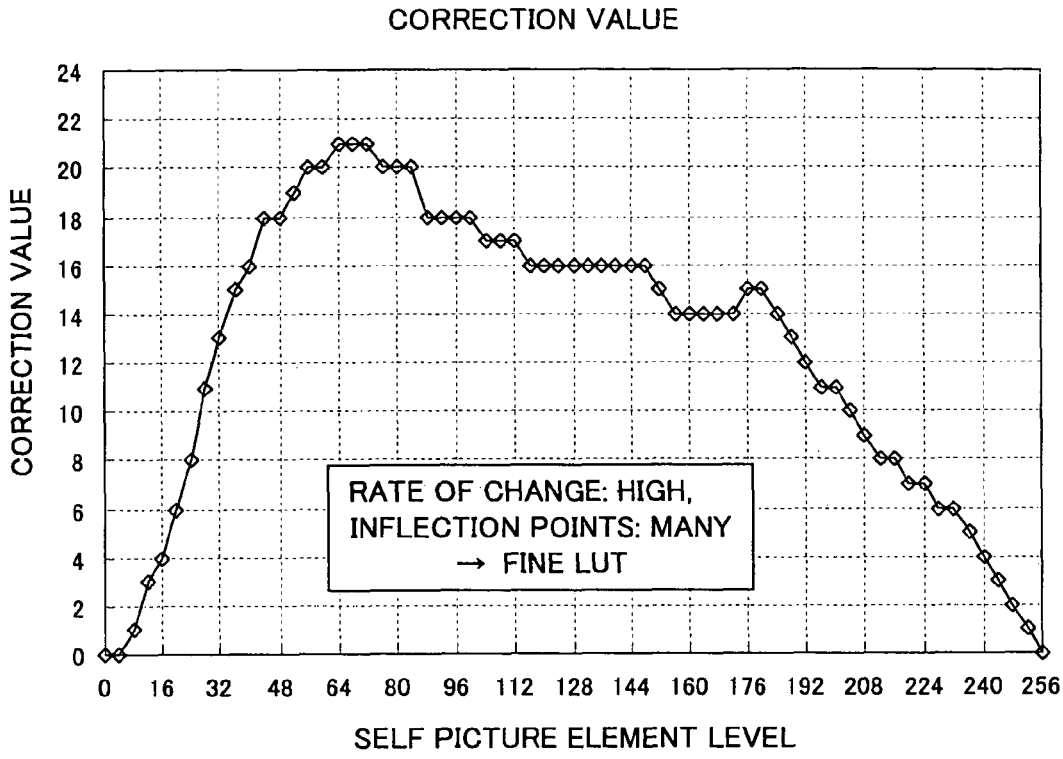
FIG. 5 shows an example of a graph when the horizontal axis is self picture element levels and the vertical axis is correction values.

The LUT must be formed with the capacity thereof made as small as possible while retaining the correction accuracy. FIG. 5 shows an example of a graph when the horizontal axis is the self picture element levels and the vertical axis is the correction values. As shown in FIG. 5, the graph with the horizontal axis of the self picture element levels is a curved line with the greater rate of change in the correction value relative to change in the input signal level and many inflection points. Therefore, finer levels must be established for setting the correction values in the LUT to ensure the correction accuracy.

Figure 6:
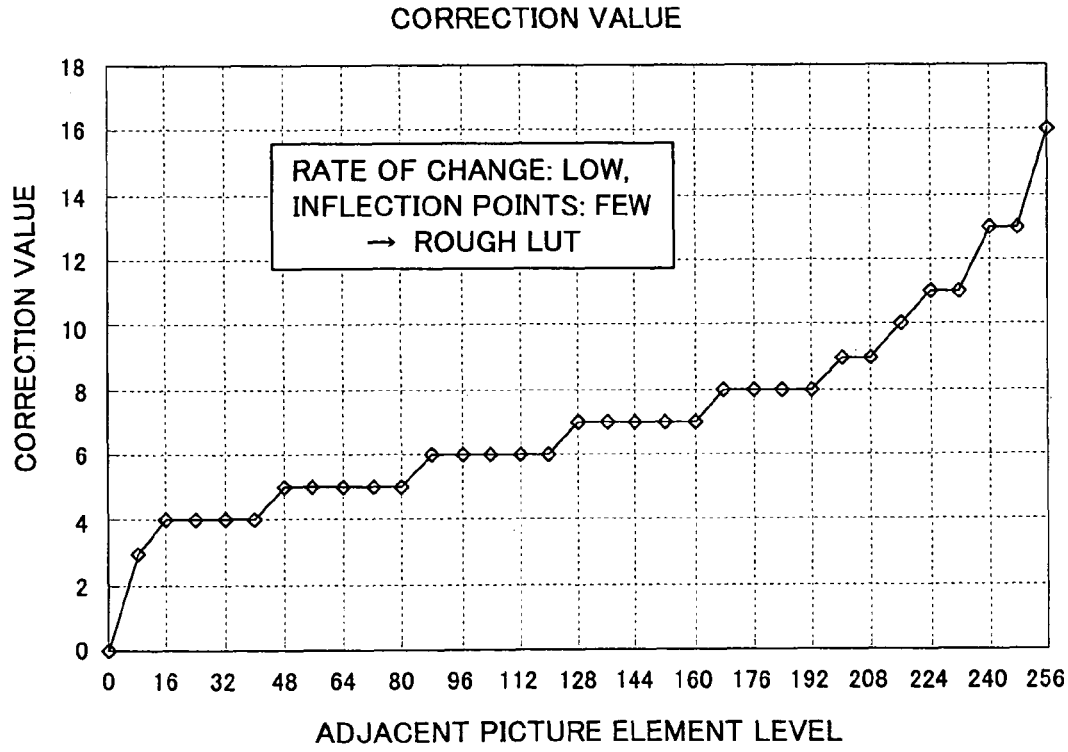
FIG. 6 shows an example of a graph when the horizontal axis is adjacent picture element levels and the vertical axis is correction values.

FIG. 6 shows an example of a graph when the horizontal axis is the adjacent picture element levels and the vertical axis is the correction values. As compared to FIG. 5, the graph with the horizontal axis of the adjacent picture element levels is a curved line with the smaller rate of change in the correction value relative to change in the input signal level and less inflection points. Therefore, the levels for setting the correction values in the LUT may not be so finely established.

As a result, with regard to the levels for setting the correction values in the LUT, the levels of the self picture element can be defined finely and the levels of the adjacent picture element can be defined relatively roughly. In the embodiment, the level of the self picture element is established by 64 stages and the level of the adjacent picture element is established by 32 stages to form the LUT. Although the setting of the levels must be changed in this LUT based on the measurement result of the crosstalk, the change in this case can be suitable performed only by changing an access mode without changing the size of the LUT such as 128×16 (7×4 bits), 32×64 (5×6 bits), etc.

(Two-Stage Configuration of LUT)

Strictly speaking, in the crosstalk correction, the self picture element must be corrected based on the result of the correction of the adjacent picture element, and the adjacent picture element must be corrected based on the result of the correction of the next adjacent picture element. That is, if the crosstalk flows from right to left in the horizontal direction of the screen, the crosstalk must be corrected sequentially from the rightmost picture element on the screen in a relay mode. However, a real time process is difficult and is not practical in this method.

Therefore, to perform practical correction with good accuracy, the LUT can be constituted by two stages to use a configuration that corrects the input signal of the adjacent picture element based on the input signal of the next adjacent picture element to correct the input signal of the self picture element based on this result.

For example, it is assumed that (RGB)=(64, 64, 255) is input. This is a pattern that causes the greatest change in the G level. Therefore, the G level is corrected first. FIG. 7 is a diagram describing the relevant portion of the LUT. In this case, when the self picture element is a G picture element, since the input level of the self picture element (G) is "64" and the input level of the adjacent picture element (B) is "255", the correction value is "−21" from the LUT of FIG. 7. The G input level of "64" is corrected with this correction value of "−21" to obtain the corrected G level of "43".

The corrected picture element G is defined as the adjacent picture element and the self picture element is defined as an R picture element to correct the R level. The input level of the self picture element R is "64" in this case and the correction value of "−7" is obtained from the corrected level of "43" of the adjacent picture element G. The input level of "64" of the self picture element R is corrected with the obtained correction value of "−7" to obtain the corrected R level of "57".

For example, if the single-stage correction is performed for the input level of "64" of the self picture element R with the use of the input level of "64" of the adjacent picture element G without considering the next adjacent picture element as described above, the correction value is "−8", which is slightly different from the correction value of "−7" in the case of considering the next adjacent picture element as described above. Therefore, by performing the two-stage correction in consideration of the next adjacent picture element, the more accurate correction can be performed as compared to the single-stage correction.

Although the B level is corrected with the use of the input level of a picture element located further to the right of the B picture element in the case of the relay mode, this correction result does not affect the correction result of the R picture element and the relay mode does not have to be used.

(Simplification of Two-Stage Configuration)

To realize the two-stage correction in consideration of the next adjacent picture element as described above, a doubled LUT is needed as compared to the single-stage correction, which generates a negative effect, which is an increased circuit scale. Therefore, the LUT on the first stage (LUT for correcting the adjacent picture element) is simplified. For example, the second stage is the LUT of 64×32 (6×5 bits) and the first stage is the LUT of 32×16 (5×4 bits). That is, the signal level intervals for setting the correction value data in the adjacent picture element correction LUT are established more roughly than the signal level intervals for setting the correction value data in the LUT for correcting the correction target picture element.

Although the self picture element can be corrected based on the correction result of the adjacent picture element when the two-stage correction is used, the correction result of the adjacent picture element does not have to be strict on this occasion and, therefore, the LUT on the first stage (LUT for correcting the adjacent picture element) can be simplified. A difference with the case of not simplifying the first stage is a negligible value.

Figure 8:
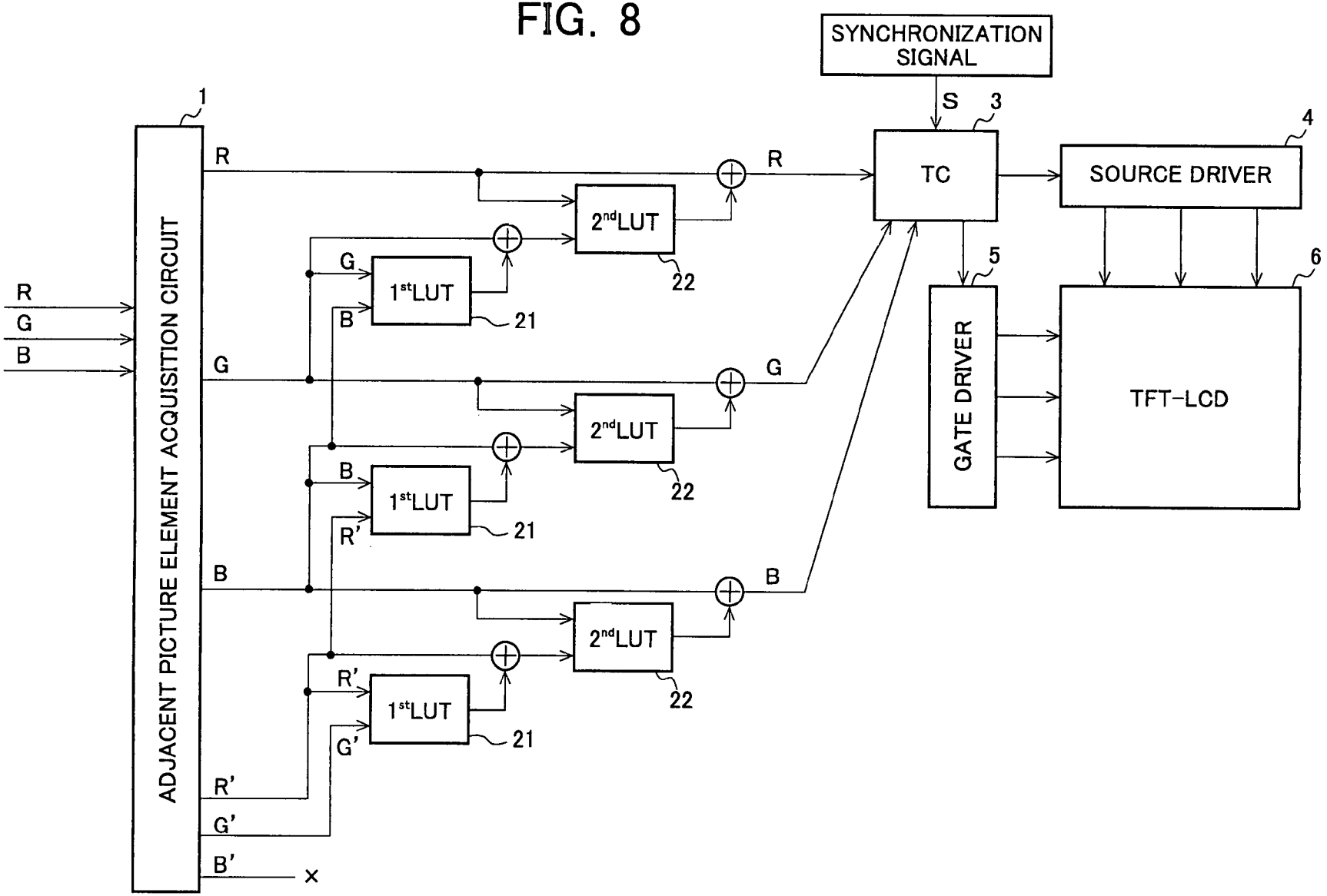
FIG. 8 is a diagram for describing another embodiment of the crosstalk elimination circuit according to the present invention.

FIG. 8 is a diagram for describing another embodiment of the crosstalk elimination circuit of the present invention for realizing the LUT with the two-stage configuration as described above and shows a block diagram of the relevant portion of the liquid crystal display apparatus. In FIG. 8, the same numerals as FIG. 1 are added to portions with the same functions as FIG. 1.

As shown in FIG. 8, to realize the LUT with the two-stage configuration and correct each primary color of RGB, a first LUT (1st LUT) 21 and a second LUT (2nd LUT) 22 are disposed for each primary color. The first LUT 21 is an adjacent picture element correction LUT for correcting the display signal (level) to the adjacent picture element adjacent to the correction target picture element (self picture element) and the second LUT 22 is a correction target picture element correction LUT for correcting the display signal (level) corresponding to the self picture element with the use of the display signal (level) corresponding to the adjacent picture element corrected with the correction value output from the first LUT 21. That is, the second LUT 22 corresponds to the aforementioned LUT 2 with the single-stage configuration.

For example, to correct the level of the self picture element R, the configuration of FIG. 8 is provided with the first LUT 21 for R that is used for acquiring the correction value of the adjacent picture element G from the input levels of the adjacent picture element G and the next adjacent picture element B and the second LUT 22 for R that is used for acquiring the correction value of the self picture element R from the level of the adjacent picture element G corrected with the correction value extracted by the first LUT 21 for R and the input level of the self picture element R. The correction value extracted from the second LUT 22 for R is added to the input level of the self picture element R and is supplied as the corrected R display signal through the timing controlling unit 3 to the picture element electrode of the self picture element R of the liquid crystal panel.

Each of other colors G, B of RGB is also corrected with the use of the levels of the adjacent picture element and the next adjacent picture element.

The present invention can be applied not only to the liquid crystal panel with the picture element configuration in the stripe arrangement as described above but also the liquid crystal panel with the picture element configuration in the delta arrangement. If the crosstalk is eliminated between two picture elements as described above, this can be accommodated only by switching the wiring of the adjacent picture element acquisition circuit 1. If the effect of the crosstalk is generated among three picture elements, the present invention can be realized by forming the LUT in a three-stage configuration, etc.

As described above, the crosstalk is generated because the quantity of the electric charge applied to the self picture element is changed by the change in the electric potential of the source line of the self picture element and the adjacent picture element. Therefore, although the effective voltage of the self picture element must be corrected by monitoring the change in the electric potential of the source line in one future frame period after the voltage is applied to the self picture element to be exact, since the change of the source line in the screen is always constant if the input side is uniform for the entire screen, this can result in a relationship between the self picture element and the adjacent picture element. For example, when used with TV (television receiver), etc., high-band components of the input image are filtered in advance and no practical problem occurs when considering that a screen (around the target picture element) is substantially uniform.

The aforementioned crosstalk elimination circuit focuses on this point and can achieve an effect of the crosstalk correction with a relatively simple configuration. Although the circuit is an effective correcting means for the image quality deterioration due to the crosstalk with a picture element located adjacently in the direction perpendicular to the simple source line of course, if the target liquid crystal panel and the input display signal are high-definition, more accurate results can be acquired by performing the correction based on the change in the electric potential of the source line. This correcting method will hereinafter be described.

A quantity of electric charge written into one picture element electrode is affected by input display signals supplied to all picture element electrodes on a self source line and an adjacent source line in one future frame period until the next time the quantity of electric charge is written again.

Factors causing the aforementioned crosstalk will be modeled. The source line 13 supplying the display signal to the picture element electrode is referred to as the self source line and the source line 13 supplying the display signal to another picture element electrode adjacent to the picture element electrode is referred to as the adjacent source line.

The electric potentials written into the self source line and the adjacent source line at time i are defined as VsSELFi and VsADJi, respectively, and the electric potential stored in the picture element electrode is defined as Vdi. When the capacity of the picture element electrode is Cpix; the coupling capacity between the self source line and the picture element electrode is CsdSELF and the coupling capacity between the adjacent source line and the picture element electrode is CsdADJ, the following equation can represent capacity coupling ratio α, β parameters.

[Equation 1]

$$\alpha = \frac{CsdSELF}{Cpix} \qquad \text{Equation (1)}$$

$$\beta = \frac{CsdADJ}{Cpix}$$

If the gate is turned on at time 1 and the picture element electrode stores an electric potential $Vd_1$, the electric potential Vdi of the picture element electrode at time i can be represented sequentially as follows. Because of the drive mode (AC inversion) of the liquid crystal panel, +/−represents + or −.

[Equation 2] Equation (2)

$$Vd_2 = Vd_1 - \alpha(VsSELF_2 - VsSELF_1) +/- \beta(VsADJ_2 - VsADJ_1)$$

$$Vd_3 = Vd_2 - \alpha(VsSELF_3 - VsSELF_2) +/- \beta(VsADJ_3 - VsADJ_2)$$

$$= Vd_1 - \alpha(VsSELF_3 - VsSELF_1) +/- \beta(VsADJ_3 - VsADJ_1)$$

$$\vdots$$

$$Vd_i = Vd_1 - \alpha(VsSELF_i - VsSELF_1) +/- \beta(VsADJ_i - VsADJ_1)$$

That is, when the number of display lines is n in one frame period, the effective voltage of the picture element electrode is as follows.

[Equation 3] Equation (3)

$$Vrms = \sqrt{\frac{1}{n}\sum_{i=1}^{n}(Vd_i)^2} = \frac{1}{\sqrt{n}}\sqrt{Vd_1^2 + \sum_{i=2}^{n}\{Vd_1 - \alpha(VsSELF_i - VsSELF_1) + / - \beta(VsADJ_i - VsADJ_1)\}^2}$$

That is, the effective voltage of the picture element electrode is affected and fluctuated by the input display signals to all the picture elements on the self source line and the adjacent source line in one future frame period after the electric charge is applied to the picture element electrode until the next time the electric charge is applied again. Description will hereinafter be made of a means for eliminating such effects.

Figure 9:
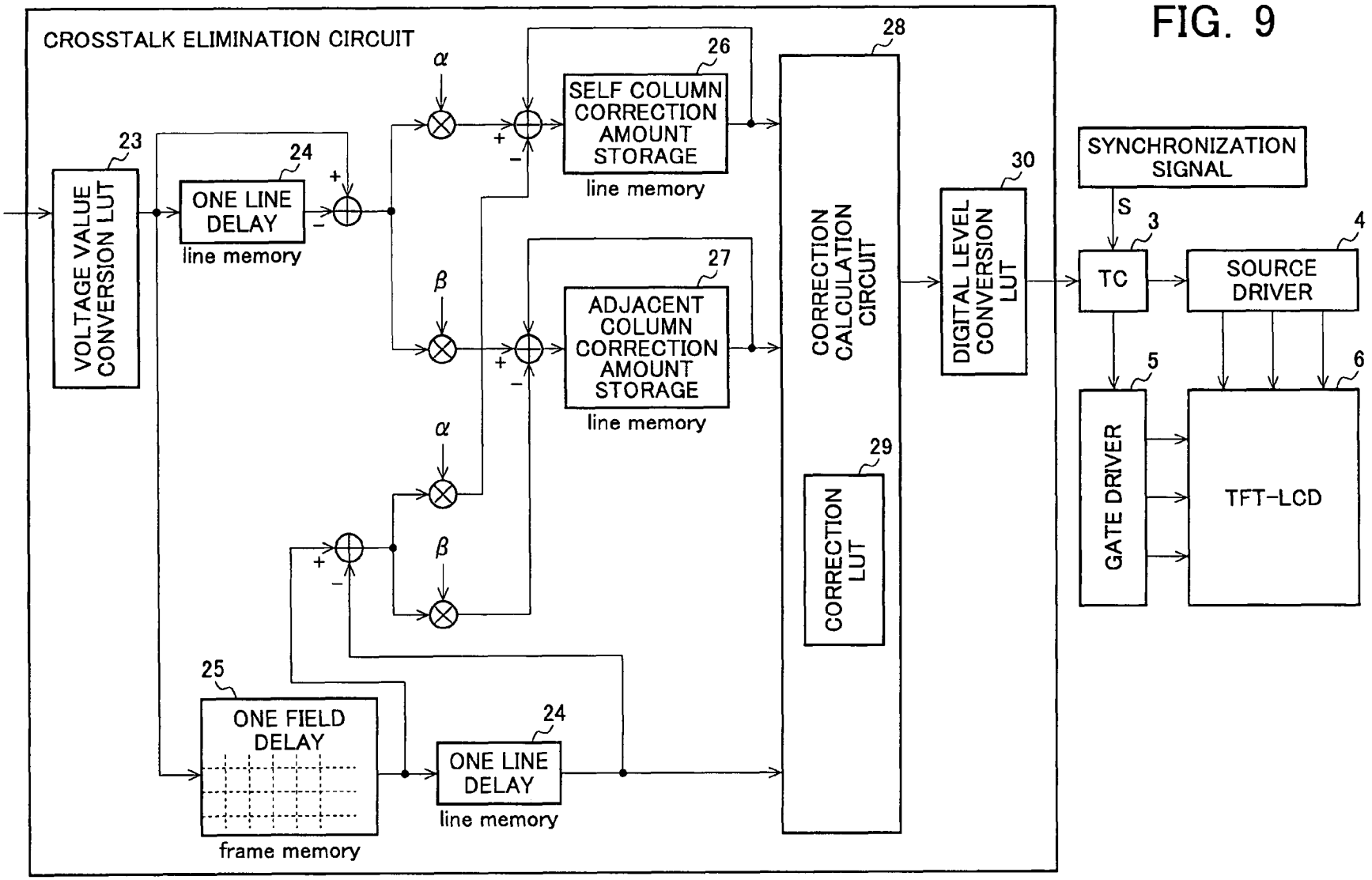
FIG. 9 is a diagram for describing another embodiment of the crosstalk elimination circuit according to the present invention.

FIG. 9 is a diagram for describing another embodiment of the crosstalk elimination circuit according to the present invention and shows a block diagram of a relevant portion of the liquid crystal display apparatus.

As shown in FIG. 9, the liquid crystal display apparatus of the present embodiment is provided with the crosstalk elimination circuit, which is a voltage value conversion LUT 23 for converting a digital level to a voltage value, a one-line delay line memory 24 for delaying an image signal of one line period, a one-frame delay frame memory 25 for delaying an image signal of one frame period, a self column correction amount storage line memory 26 that stores a self column correction amount of one frame period, an adjacent column correction amount storage line memory 27 that stores an adjacent column correction amount, a correction calculation circuit 28, an LUT 29 for extracting the correction amount, and a digital level conversion LUT 30 that converts a voltage value to a digital level.

Since voltage values are used when obtaining a correction amount in the crosstalk elimination circuit, the voltage value conversion LUT 23 converts an input image signal to a voltage value. The voltage value conversion LUT 23 is created based on voltage characteristics specific to the TFT-LCD 6. Since the voltage characteristics are specific to the TFT-LCD 6, it is desirable that the characteristics can be rewritten externally.

The line memory 24 for one-line delay is used for acquiring a difference between the voltage value of the picture element electrode and the voltage value of a lower adjacent picture element electrode in the direction horizontal to the source line of the liquid crystal panel. By delaying the input voltage value of the picture element electrode for one line period, the voltage value can be acquired for the lower adjacent picture element electrode in the direction horizontal to the source line of the picture element electrode to acquire the difference with the voltage value of the picture element electrode.

Since the one-frame delay frame memory 25 must store the input display signals to all the picture elements arranged in the direction horizontal to the source line of the picture element electrode in one future frame period after the display signal corresponding to the picture element is input until the next time the display signal is input again, the one-frame delay frame memory 25 delays the voltage value of the picture element electrode for one frame period and outputs the voltage value.

The difference between the voltage value of the picture element electrode and the voltage value of the lower adjacent picture element electrode in the direction horizontal to the source line of the picture element electrode is multiplied by each of capacity coupling ratios α, β. The capacity coupling ratios α, β are obtained from Equation 1 described above. Since the capacity coupling ratios α, β are specific values of the TFT-LCD 6, it is desirable that the ratios can be rewritten externally.

The self column correction amount storage line memory 26 and the adjacent column correction amount storage line memory 27 are used for storing the voltage values of all the picture element electrodes arranged in the direction horizontal to the source line of the picture element electrode as well as the voltage values of an adjacent picture element electrode in the direction vertical to the source line of the picture element electrode and all the picture element electrodes arranged in the direction horizontal to the source line of the picture element electrode for one future frame period. That is, the difference between the voltage value of the picture element electrode and the voltage value of the lower adjacent picture element electrode in the direction horizontal to the source line of the picture element electrode is multiplied by each of the capacity coupling ratios α, β and added and accumulated into the self column correction amount storage line memory 26 and the adjacent column correction amount storage line memory 27.

Since the value must be subtracted which is added one frame period before correspondingly to the picture element, the correction amount of one frame period before is calculated again with the use of the voltage value of the picture element electrode delayed for one frame period by the one-frame delay frame memory 25, is subtracted from the correction amount of the picture element, and is then accumulated in each correction amount storage line memory 26, 27.

The correction calculation circuit 28 corrects the voltage value applied to the picture element electrode based on the values stored in the self column correction amount storage line memory 26 and the adjacent column correction amount storage line memory 27 and the voltage value of the picture element electrode delayed for one frame period by the one-frame delay frame memory 25. The correction is performed by using Equation 3 described above in this correction calculation. Alternatively, the correction value can be extracted with the use of the correction LUT 29 to correct the picture element signal. Since the correction value of the correction LUT 29 is specific to the TFT-LCD 6, it is desirable that the values can be rewritten externally.

The digital level conversion LUT 30 converts again the voltage value corrected by the correction calculation circuit 28 into a digital level, which is output as a digital image signal to the subsequent stage. The digital level conversion LUT 30 is created based on voltage characteristics specific to the TFT-LCD 6. Since the voltage characteristics are specific to the TFT-LCD 6, it is desirable that the characteristics can be rewritten externally.

The aforementioned LUTs 23, 29, 30 can be realized easily with RAMs and ROMs.

The signal corrected by the crosstalk elimination circuit with the above configuration is input to the timing controlling unit (TC) 3, and the timing controlling unit 3 outputs the display signal to the source driver 4 depending on the vertical and horizontal synchronization signal S applied externally and outputs the scan signal for scanning the TFT to the gate driver 5. Since the liquid crystal panel is driven by the source driver 4 and the gate driver 5, the above configuration can correct the crosstalk generated in the direction horizontal to the source line, i.e., the crosstalk generated in the vertical direction of the screen and can display high-definition images.

In the aforementioned embodiment, the crosstalk of the picture element electrode generated by the effects from the source line of the picture element electrode and the adjacent source line can be eliminated almost accurately by correcting the display signal of the picture element electrode with the use of display signals input to picture element electrodes arranged along the source line of the picture element electrode and display signals input to picture element electrodes arranged along the adjacent source line parallel to the source line during one future frame period after the display signal is input to the picture element electrode until the next time the display signal is input again.

Although description has been made of eliminating the crosstalk generated when the capacity coupling exists among the source line of the picture element electrode, the adjacent source line, and the picture element electrode in the aforementioned embodiment, for example, if the capacity coupling with the adjacent source line does not exist, the crosstalk of the picture element electrode generated by the effect from the source line of the picture element electrode can be eliminated by correcting the display signal of the picture element electrode with the use of display signals input to the picture element electrodes arranged along the source line of the picture element electrode and the display signal input to the picture element electrode only.

During one future frame period after the display signal is input to the picture element electrode until the next time the display signal is input again, an effect may be exerted from the display signals input to the picture element electrodes of the entire screen due to factors such as electrode wiring. In this case, the crosstalk generated by the effects from other picture elements in the entire screen can be eliminated by correcting the display signal input to the picture element electrode with the use of all the data for each picture element column stored in the correction amount storage line memories 26, 27 of the aforementioned embodiment.

Figure 10:
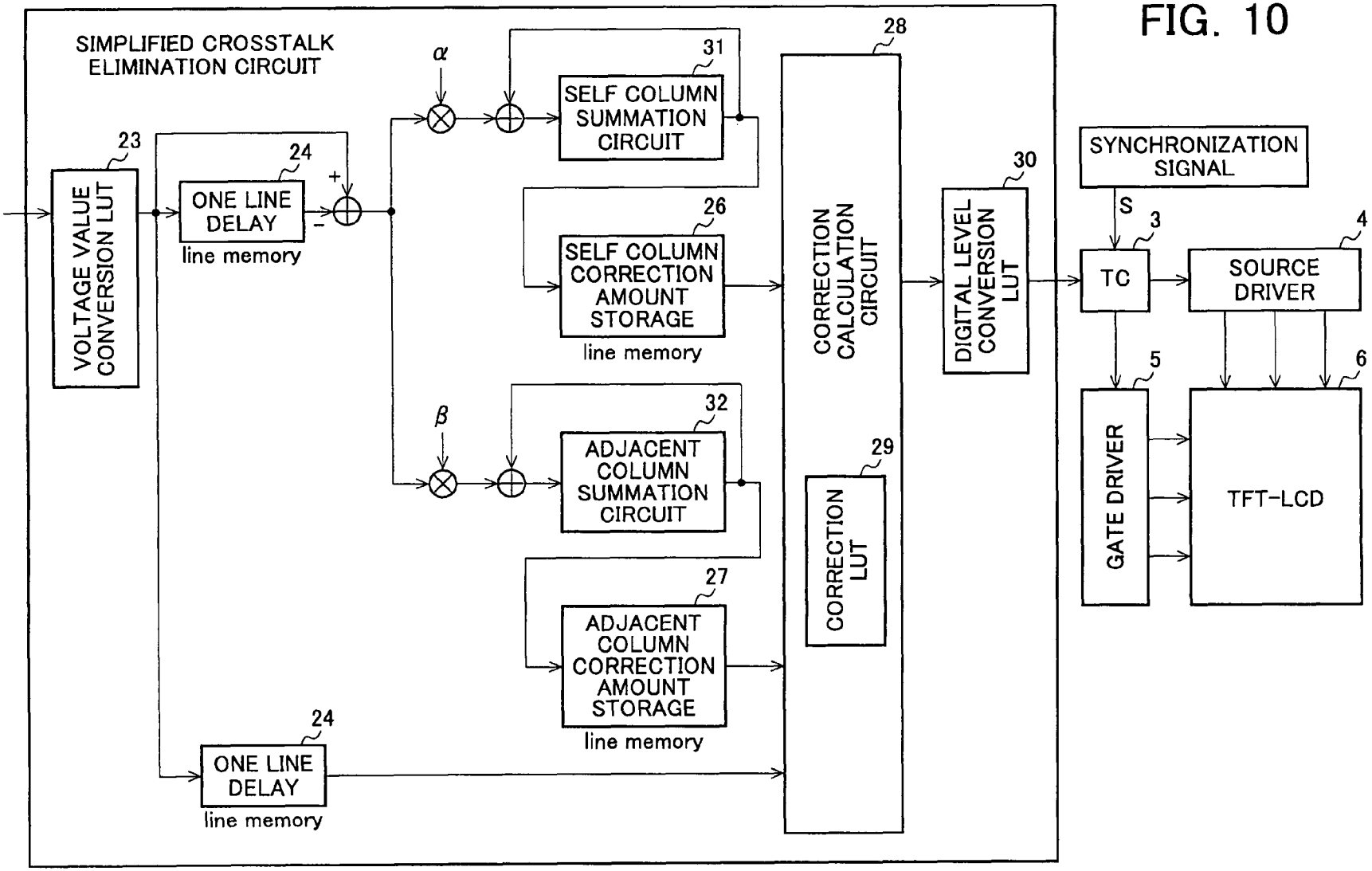
FIG. 10 is a diagram for describing another embodiment of the crosstalk elimination circuit according to the present invention.
Figure 13:
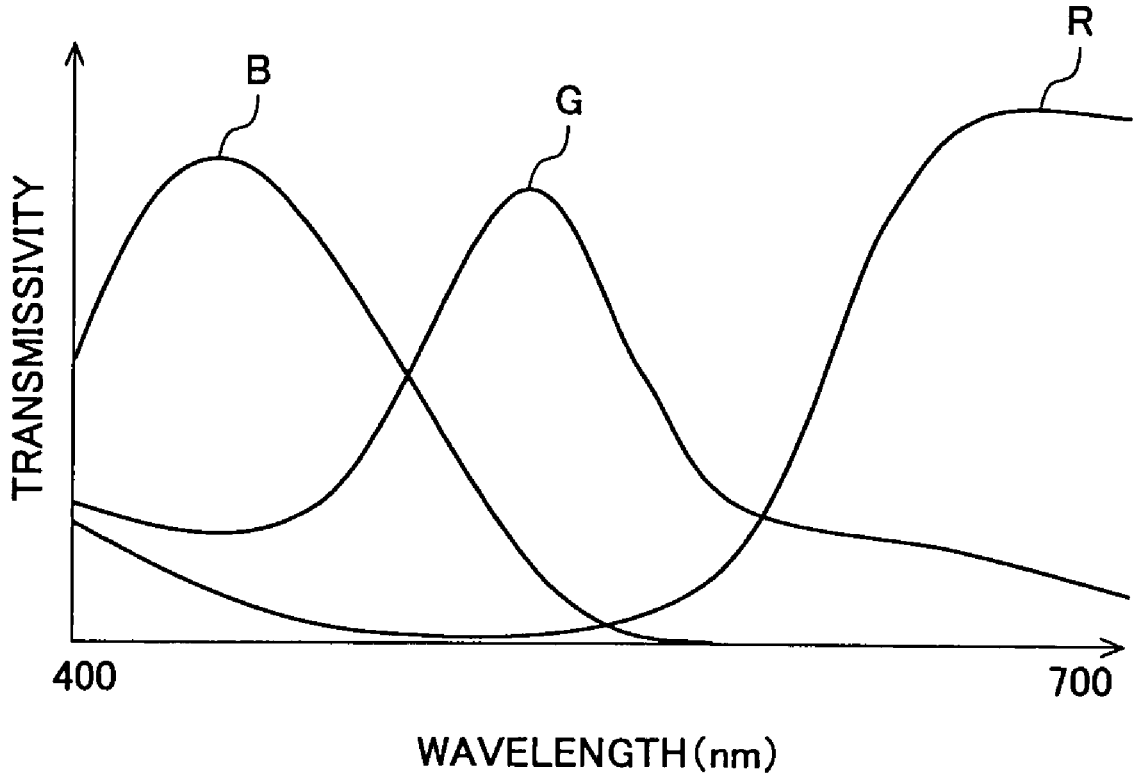
FIG. 13 shows spectral characteristics of a general color filter.

FIG. 10 is a diagram for describing another embodiment simplifying the above configuration of the crosstalk elimination circuit and shows a block diagram of a relevant portion of the liquid crystal display apparatus. In FIG. 10, the same numerals as FIG. 9 are added to portions with the same functions as FIG. 9. This embodiment can reduce the capacity of the circuit scale without using the one frame delay frame memory. Description will hereinafter be made of the embodiment of the simplified crosstalk elimination circuit according to the present invention.

As shown in FIG. 10, the liquid crystal display apparatus according to the embodiment is provided with the crosstalk elimination circuit, which is the voltage value conversion LUT 23 for converting a digital level to a voltage value, the one-line delay line memory 24 for delaying an image signal of one line period, a self column summation circuit 31 that calculates a self column correction amount of one frame period, an adjacent column summation circuit 32 that calculates an adjacent column correction amount of one frame period, the self column correction amount storage line memory 26 that stores a self column correction amount of one frame period, the adjacent column correction amount storage line memory 27 that stores an adjacent column correction amount, the correction calculation circuit 28, the LUT 29 for extracting the correction amount, and the digital level conversion LUT 30 that converts a voltage value to a digital level.

Since voltage values are used when obtaining a correction amount in the crosstalk elimination circuit, the voltage value conversion LUT 23 converts an input image signal to a voltage value. The voltage value conversion LUT 23 is created based on voltage characteristics specific to the TFT-LCD 6. Since the voltage characteristics are specific to the TFT-LCD 6, it is desirable that the characteristics can be rewritten externally.

The line memory 24 for one-line delay is used for acquiring a difference between the voltage value of the picture element electrode and the voltage value of a lower adjacent picture element electrode in the direction horizontal to the source line of the liquid crystal panel. By delaying the input voltage value of the picture element electrode for one line period, the voltage value can be acquired for the lower adjacent picture element electrode in the direction horizontal to the source line of the picture element electrode to acquire the difference with the voltage value of the picture element electrode.

The difference between the voltage value of the picture element electrode and the voltage value of the lower adjacent picture element electrode in the direction horizontal to the source line of the picture element electrode is multiplied by each of capacity coupling ratios $\alpha$, $\beta$. The capacity coupling ratios $\alpha$, $\beta$ are obtained from Equation 1 described above. Since the capacity coupling ratios $\alpha$, $\beta$ are specific values of the TFT-LCD 6, it is desirable that the ratios can be changed externally.

The self column summation circuit 31 and the adjacent column summation circuit 32 are used for storing the voltage values of all the picture element electrodes arranged in the direction horizontal to the source line of the picture element electrode as well as the voltage values of an adjacent picture element electrode in the direction vertical to the source line of the picture element electrode and all the picture element electrodes arranged in the direction horizontal to the source line of the adjacent picture element electrode for one future frame period. That is, the difference between the voltage value of the picture element electrode and the voltage value of the lower adjacent picture element electrode in the direction horizontal to the source line of the picture element electrode is multiplied by each of the capacity coupling ratios $\alpha$, $\beta$ and added and accumulated into the self column summation circuit 31 and the adjacent column summation circuit 32.

The voltage values accumulated for one frame in the self column summation circuit 31 and the adjacent column summation circuit 32 are transferred to the self column correction amount storage line memory 26 and the adjacent column correction amount storage line memory 27 in accordance with the next frame display start timing (vertical synchronization signal).

The self column correction amount storage line memory 26 and the adjacent column correction amount storage line memory 27 retain the voltage values transferred from the self column summation circuit 31 and the adjacent column summation circuit 32 for one frame period and transfer the voltage value corresponding to the input display signal to the correction calculation circuit 28.

The correction calculation circuit 28 corrects the voltage value applied to the picture element electrode based on the values retained in the self column correction amount storage line memory 26 and the adjacent column correction amount storage line memory 27 and the voltage value of the picture element electrode delayed for one line period by the one-line delay line memory 24. The correction is performed by using Equation 3 described above in this correction calculation. Alternatively, the correction value can be extracted with the use of the correction LUT 29 to correct the picture element. Since the correction value of the correction LUT 29 is specific to the TFT-LCD 6, it is desirable that the values can be rewritten externally.

The digital level conversion LUT 30 converts again the voltage value corrected by the correction calculation circuit 28 into a digital level, which is output as a digital image signal to the subsequent stage. The digital level conversion LUT 30 is created based on voltage characteristics specific to the TFT-LCD 6. Since the voltage characteristics are specific to the TFT-LCD 6, it is desirable that the characteristics can be rewritten externally.

The aforementioned LUTs 23, 29, 30 can be realized easily with RAMs and ROMs.

The signal corrected by the simplified crosstalk elimination circuit with the above configuration is input to the timing controlling unit (TC) 3, and the timing controlling unit 3 outputs the display signal to the source driver 4 depending on the vertical and horizontal synchronization signal S applied externally and outputs the scan signal for scanning the TFT to the gate driver 5. Since the liquid crystal panel is driven by the source driver 4 and the gate driver 5, the above configuration can correct the crosstalk generated in the direction horizontal to the source line, i.e., the crosstalk generated in the vertical direction of the screen and can display high-definition images.

Although the crosstalk cannot be completely corrected by the aforementioned simplified crosstalk elimination circuit, for example, when used with TV (television receiver), etc., high-band components of the input image are filtered in advance; no problem occurs when considering that an entire screen is substantially uniform; a difference of image signals is small between frames (inter-frame correlation is high); especially, sensitivity to color difference is low in the characteristics of the human visual sense; and, therefore, no practical problem occurs. The simplified crosstalk elimination circuit focuses on this point and can achieve the effect of the correction using the configuration with the circuit scale reduced.

In the aforementioned embodiment, the crosstalk of the picture element electrode generated by the effects from the source line of the picture element electrode and the adjacent source line can be eliminated almost accurately by correcting the display signal of the picture element electrode with the use of display signals input to the picture element electrodes arranged along the source line of the picture element electrode and display signals input to the picture element electrodes arranged along the adjacent source line parallel to the source line during one past frame period until the display signal is input to the picture element electrode.

Although description has been made of eliminating the crosstalk generated when the capacity coupling exists among the source line of the picture element electrode, the adjacent source line, and the picture element electrode in the aforementioned embodiment, for example, if the capacity coupling with the adjacent source line does not exist, the crosstalk of the picture element electrode generated by the effect from the source line of the picture element electrode can be eliminated almost accurately by correcting the display signal of the picture element electrode with the use of the display signals input to the picture element electrodes arranged along the source line of the picture element electrode and the display signal input to the picture element electrode only.

During one past frame period before the display signal is input to the picture element electrode, an effect may be exerted from the display signals input to the picture element electrodes of the entire screen due to factors such as electrode wiring. In this case, the crosstalk of the picture element electrode generated by the effects from other picture elements in the entire screen can be eliminated almost accurately by correcting the display signal input to the picture element electrode with the use of all the data for each picture element column stored in the correction amount storage line memories 26, 27 of the aforementioned embodiment.

Description will be made of an optical measuring method when the LUT 2 and the correction LUT 29 are created according to the embodiment of the present invention described above. Assuming that Wm, Rm, Gm, and Bm are white, red, green, and blue display luminance, respectively, due to the picture element display signal at a predetermined level m for each primary color, Wm=Rm+Gm+Bm is considered to be ideal. However, since the aforementioned crosstalk is generated, Wm=Rm+Gm+Bm is not achieved. Similarly, assuming that RmGn is display luminance due to the picture element display signal at predetermined levels m, n for red and green picture elements, RmGn=Rm+Gn is not achieved.

In the optical measurement for creating the LUT, two colors of RGB are used. For example, the correction value is determined based on the optical measurement of the display luminance, for example, by turning on the adjacent red and green picture elements at the same time and changing each of the predetermined levels m, n. Assuming that Hr and Hg are correction values for the predetermined levels of the red and green picture elements, the correction values Hr and Hg are extracted such that R(m+Hr)G(n+Hg)=Rm+Gn is satisfied. Similarly, the same optical measurement is performed for the green and blue picture elements and the blue and red picture elements.

As described above, the crosstalk includes the electric crosstalk and the optical crosstalk. The electric crosstalk occurs in the vertical and horizontal directions between the adjacent picture elements since a parasitic capacity exists between the bus electrode and the picture element electrode. Since the optical crosstalk is light leakage due to a difference between spectral wavelength characteristics of the color filter and backlight, the optical crosstalk occurs in the horizontal, vertical, and oblique directions. Therefore, the crosstalk elimination circuit of the present invention can eliminate not only the electric crosstalk but also the optical crosstalk by creating the LUT additionally considering the light leakage of the color filter, etc., from the optical measurement result described above. Therefore, the crosstalk elimination circuit of the present invention can eliminate all types of the crosstalk generated in the vertical, horizontal, and oblique directions of the screen.

In the above description, other picture element electrodes arranged in the direction horizontal to the source line of the picture element electrode are picture element electrodes disposed along the source line connected to the picture element electrode. The picture element electrodes arranged adjacently in the direction vertical to the source line of the picture element electrode are picture element electrodes disposed along the gate line connected to the picture element electrode.

In the above description, it is detailed that the present invention performs the correction such that the display luminance of the picture element electrode becomes substantially constant. It is well-known fact at the time of filing of the present application that the human visual sense has color tolerance, and the substantial constancy in this case indicates a degree or range when an observer sufficiently recognizes color as an actual color. For example, FIG. 11 shows levels of a color difference ΔE and general degrees of the visual sense, and the substantial constancy corresponds to a range that can be handled as the same colors at an impression level of FIG. 11, i.e., a level when the color difference is 6.5 or less.

The invention claimed is:

1. A crosstalk elimination circuit that corrects a display signal input to each of a plurality of picture element electrodes provided in a liquid crystal panel to eliminate crosstalk of a liquid crystal display apparatus using the liquid crystal panel, the circuit comprising:

an LUT that inputs a display signal of a correction target picture element and a display signal of an adjacent picture element adjacent to a source line of the correction target picture element in a first direction, the LUT outputting a correction signal for correcting the display signal of the correction target picture element, and an adjacent picture element correction LUT for correcting the display signal of the adjacent picture element adjacent to the correction target picture element, wherein the adjacent picture element correction LUT uses a display signal of a next adjacent picture element adjacent to a source line of the adjacent picture element in the first direction and the display signal of the adjacent picture element to extract correction value data of the adjacent picture element, which are output as an adjacent picture element correction signal, and wherein the LUT for correcting the correction target picture element inputs the display signal of the adjacent picture element corrected with the use of the signal output from the adjacent picture element correction LUT and the display signal of the correction target picture element to extract the correction data of the correction target picture element.

2. The crosstalk elimination circuit as defined in claim 1, wherein signal level intervals for setting the correction value data in the adjacent picture element correction LUT are established more roughly than the signal level intervals for setting the correction value data in the LUT for correcting the correction target picture element.

3. The crosstalk elimination circuit as defined in claim 1, wherein signal level intervals for setting correction value data in the LUT are established roughly by a predetermined level width relative to a level width that may be achieved by the signal level of the display signal input to each picture element electrode.

4. The crosstalk elimination circuit as defined in claim 3, wherein when extracting from the LUT the correction value data corresponding to the signal level between the signal levels with the correction value data set, the target correction value data are extracted by performing linear interpolation between the signal levels.

5. The crosstalk elimination circuit as defined in claim 4, wherein when the LUT is created by omitting regions where the correction value data are zero which are extracted with the use of the signal level of the correction target picture element and the signal level of the adjacent picture element and when the linear interpolation is performed between a signal level having the correction value data of zero and a signal level set adjacently to the signal level, the target correction value data are extracted by performing the linear interpolation between the correction value data of the adjacently set signal level and fixed correction value data 0 defined in advance.

6. The crosstalk elimination circuit as defined in claim 3, wherein the signal level intervals for setting the correction value data in the LUT are established with finer intervals of the signal levels of the correction target picture element as compared to the signal levels of the adjacent picture element.

7. The crosstalk elimination circuit as defined in claim 1, wherein the LUT is disposed for each primary color of RGB to enable individual setup of the correction value of the LUT for each color.

8. A liquid crystal display apparatus provided with the crosstalk elimination circuit as defined in claim 1.

* * * * *